US006215454B1

(12) United States Patent
Tran

(10) Patent No.: US 6,215,454 B1
(45) Date of Patent: Apr. 10, 2001

(54) MULTI-LAYERED SHIELDED SUBSTRATE ANTENNA

(75) Inventor: Allen Tran, San Diego, CA (US)

(73) Assignee: Qualcomm, Inc., San Diego, CA (US)

( * ) Notice: Subject to any disclaimer, the term of this patent is extended or adjusted under 35 U.S.C. 154(b) by 0 days.

(21) Appl. No.: 09/059,605

(22) Filed: Apr. 13, 1998

Related U.S. Application Data

(60) Provisional application No. 60/075,617, filed on Feb. 20, 1998.

(51) Int. Cl.[7] ..... H01Q 1/52

(52) U.S. Cl. ..... 343/841; 343/702; 343/872

(58) Field of Search ..... 343/700 MS, 702, 343/841, 846, 848, 872, 873; H01Q 1/52

(56) References Cited

U.S. PATENT DOCUMENTS

| | | | | |
|---|---|---|---|---|
| 4,001,834 | | 1/1977 | Smith | 343/754 |
| 4,170,013 | * | 10/1979 | Black | 343/700 MS |
| 4,814,776 | | 3/1989 | Caci et al. | 343/702 |
| 5,394,160 | * | 2/1995 | Iwasaki et al. | 343/702 |
| 5,642,120 | * | 6/1997 | Fujisawa | 343/702 |
| 5,650,790 | * | 7/1997 | Fukuchi et al. | 343/702 |
| 5,691,732 | * | 11/1997 | Tsuru et al. | 343/702 |
| 5,701,128 | | 12/1997 | Okada et al. | 343/700 |
| 5,777,586 | * | 7/1998 | Luxon et al. | 343/700 MS |

FOREIGN PATENT DOCUMENTS

| | | | | |
|---|---|---|---|---|
| 2745928 | | 3/1996 | (FR) | G06K/19/07 |
| 2755303 | | 10/1996 | (FR) | H01Q/13/00 |
| 0246026 | * | 11/1987 | (JP) | H01Q/1/24 |

* cited by examiner

*Primary Examiner*—Tho Phan
(74) *Attorney, Agent, or Firm*—Phillip Wadsworth; Charles D. Brown; Tom Streeter

(57) ABSTRACT

A substrate antenna that includes conductive shielding positioned adjacent to and covering at least two, preferably opposing, sides of a conductive trace or antenna structure formed by the trace or traces, supported on a substrate. The conductive enclosure is realized by using a tubular material or planar conductive layers positioned adjacent to the trace. Preferably, shielding layers are disposed on at least two opposing sides of the trace. In one embodiment, a layer of dielectric material is formed over the antenna trace, and one shielding layer is formed on a surface of the substrate opposite that of the trace, and a second shielding layer is formed on the non-conductive material, effectively sandwiching the trace and substrate between them. In further embodiments, a conductive surface is formed between and joining together the two shielding layers, along either one or two sides of the trace or substrate. One method of forming this surface is to apply a planar layer of conductive material extending between and coupled to the first and second conductive shielding layers. Alternatively, a plurality of conductive vias are formed extending through the substrate between and coupled to the first and second conductive shielding layers. A passage is provided through or around an end of the shielding enclosure near a conductive pad to provide appropriate access with a signal feed for the antenna.

3 Claims, 15 Drawing Sheets

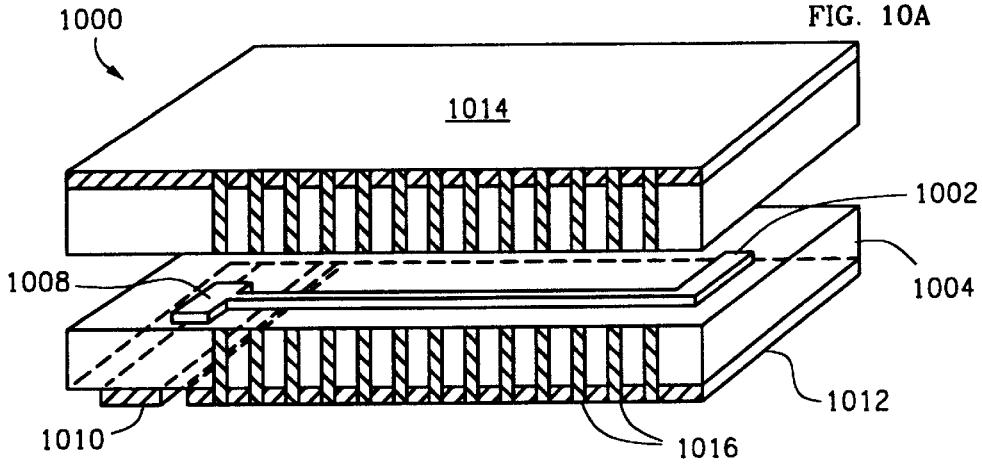
FIG. 10A
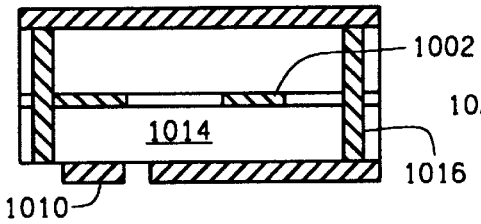
FIG. 10B
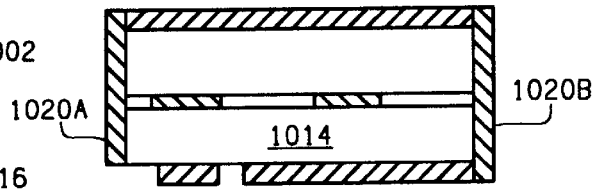
FIG. 10C
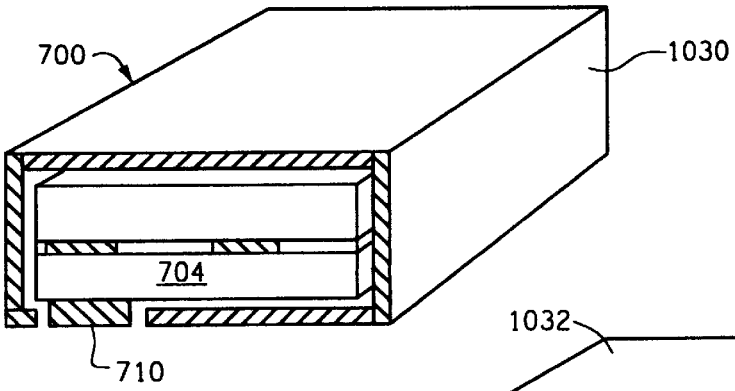
FIG. 10D
FIG. 10E
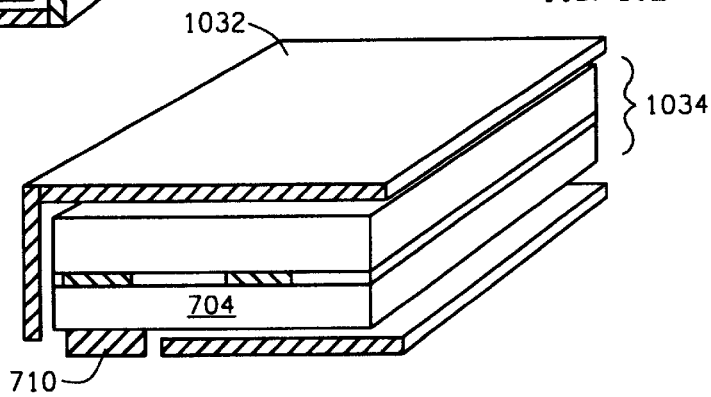

MULTI-LAYERED SHIELDED SUBSTRATE ANTENNA

This application claims benefit to provisional application 60/075,617 filed Feb. 20, 1998.

BACKGROUND OF THE INVENTION

I. Field of the Invention

The present invention relates generally to antennas for wireless devices, and more specifically, to a substrate mounted antenna. The invention further relates to internal substrate antennas for wireless devices, having conductive shielding positioned adjacent to the antenna traces to improve energy distribution, hand loading, and resonance characteristics.

II. Description of the Related Art

Antennas are an important component of wireless communication devices and systems. Although antennas are available in numerous different shapes and sizes, they each operate according to the same basic electromagnetic principles. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with an increase in use of personal wireless communication devices, such as hand-held and mobile cellular and personal communication services (PCS) phones, the need for suitable small antennas for such communication devices has increased. Recent developments in integrated circuits and battery technology have enabled the size and weight of such communication devices to be reduced drastically over the past several years. One area in which a reduction in size is still desired is communication device antennas. This is due to the fact that the size of the antenna can play an important role in decreasing the size of the device. In addition, the antenna size and shape impacts device aesthetics and manufacturing costs.

One important factor to consider in designing antennas for wireless communication devices is the antenna radiation pattern. In a typical application, the communication device must be able to communicate with another such device or a base station, hub, or satellite which can be located in any number of directions from the device. Consequently, it is essential that the antennas for such wireless communication devices have an approximately omnidirectional radiation pattern, or a pattern that extends upward from a local horizon.

Another important factor to be considered in designing antennas for wireless communication devices is the antenna's bandwidth. For example, wireless devices such as phones used with PCS communication systems operate over a frequency band of 1.85–1.99 GHz, thus requiring a useful bandwidth of 7.29 percent. A phone for use with typical cellular communication systems operates over a frequency band of 824–894 MHz, which requires a bandwidth of 8.14 percent. Accordingly, antennas for use on these types of wireless communication devices must be designed to meet the appropriate bandwidth requirements, or communication signals are severely attenuated.

One type of antenna commonly used in wireless communication devices is the whip antenna, which is easily retracted into the device when not in use. There are, however, several disadvantages associated with the whip antenna. Often, the whip antenna is subject to damage by catching on objects, people, or surfaces when extended for use, or even when retracted. Even when the whip antenna is designed to be retractable in order to minimize such damage, it can still require a minimum device housing dimension when retracted that is larger than desired.

Whip antennas are often used in conjunction with short helical antennas which are activated when the whip is retracted into the phone. The helical antenna provides the same radiator length in a more compact space to maintain appropriate radiation coupling characteristics. While the helical antenna is much shorter, it still protrudes a substantial distance from the surface of the wireless device impacting aesthetics and catching on other objects. To position such an antenna internal to the wireless device would require a substantial volume, which is undesirable. In addition, such helical antennas seem to be very sensitive to hand loading by wireless device users.

Another type of antenna which might appear suitable for use in wireless communication devices is a microstrip or stripline antenna. However, such antennas suffer from several drawbacks. They tend to be much larger than desired, suffer from lower bandwidth, and lack desirable omnidirectional radiation patterns.

As the term suggests, a microstrip antenna includes a patch or a microstrip element, which is also commonly referred to as a radiator patch. The length of the microstrip element is set in relation to the wavelength $\lambda_0$ associated with a resonant frequency $f_0$, which is selected to match the frequency of interest, such as 800 MHz or 1900 MHz. Commonly used lengths of microstrip elements are half wavelength ($\lambda_0/2$) and quarter wavelength ($\lambda_0/4$). Although, a few types of microstrip antennas have recently been used in wireless communication devices, further improvement is desired in several areas. One such area in which a further improvement is desired is a reduction in overall size. Another area in which significant improvement is required is in bandwidth. Current patch or microstrip antenna designs do not appear to obtain the desired 7.29 to 8.14 percent or more bandwidth characteristics desired for use in most communication systems, in a practical size.

Conventional patch and strip antennas have further problems when placed near the extensive ground planes found within most wireless devices. The ground planes can alter the resonant frequency, creating a non-repeatable manufactured design. The minimum surface area also prevents mounting in a fashion that optimizes the radiation patterns. In addition, "hand loading", that is, placement of a user's hand near the antenna dramatically shifts the resonant frequency and performance of the antenna.

Radiation patterns are extremely important not only for establishing a communication link as discussed above, but also in relation to government radiation standards for wireless device users. The radiation patterns must be controlled or adjusted so that a minimum amount of radiation can be absorbed by device users. There are governmental standards established for the amount of radiation that can be allowed near the wireless device user. One impact of these regulations is that internal antennas cannot be positioned in many locations within a wireless device because of theoretical radiation exposure for the user. However, as stated above, when using current antennas in other locations, ground planes and other structures often interfere with their effective use.

With the above problems in mind a new type of antenna referred to as a substrate antenna has been developed to provide an internal antenna for wireless devices having appropriate bandwidth characteristics along with reduced size, adequate gain, and reduced response to or impact from hand loading, head absorption, or similar problems encountered within the art. This type of antenna is disclosed in copending U.S. patent application Ser. No. 09/028,510 (Attorney docket No. QCPA518) entitled "Substrate Antenna" filed on Feb. 23, 1998 and assigned to the same assignee as the present invention, and which is incorporated herein by reference.

Although the substrate antenna advances the art of internal antennas and solves several problems in the art, there are some situations in which the antenna does not meet desired sensitivity or energy distribution characteristics. That is, hand loading or similar effects impact the antenna resonance shifting the resonant (center) frequency degrading performance. At the same time, more energy may be directed into a user's hands or head than desired in some applications.

In addition, a typical placement for substrate antennas is near RF and digital circuitry processing communication signals for the wireless device. This may cause the antenna to acquire spurious noise signals from such sources, which in turn can degrade the reception sensitivity of the device.

Therefore, a new substrate antenna structure and technique for manufacturing internal device antennas is desired to achieve internal antennas having desired sensitivity gain and radiation characteristics.

SUMMARY

In view of the above and other problems found in the art relative to manufacturing internal antennas for wireless devices, one purpose of the present invention is to provide an antenna with decreased interaction between wireless device users and the antenna which otherwise degrades performance.

Another purpose of the invention is to provide an antenna with decreased spurious noise and RF signal acquisition from sources in close proximity but increased sensitivity to desired communication signals.

One advantage of the invention is that it provides a very compact antenna with desired radiation characteristics and gain for mounting within a wireless device.

These and other purposes, objects, and advantages are realized in a method and apparatus for shielding a substrate antenna for use in wireless devices, that includes at least one conductive trace or radiator supported or formed on a non-conductive support substrate. The substrate generally comprises a dielectric material with a layer of metallic material deposited on one surface, which is etched or processed to form one or more connected traces. The substrate is preferably mounted offset from, or adjacent to an edge of and generally perpendicular to, a ground plane associated with circuits and components within the device with which the antenna is being used.

The substrate has a predetermined thickness and length. Appropriate dimensions are selected for trace length, width and general shape, based on wavelengths of interest for the wireless device, and space allocated for the antenna, so that it acts as an active radiator of electromagnetic energy at at least one preselected frequency.

A conductive enclosure or shielding structure is positioned adjacent to and covering at least two, preferably opposing, sides of the conductive trace or the antenna structure formed by the trace or traces. In one embodiment of the invention, the conductive enclosure is realized by using a tubular shaped material which is positioned to at least partially surround the trace. Such tubular material can have a variety of cross-sectional shapes including, but not limited to, rectangular, circular, elliptical, and so forth, and can be manufactured using extrusion techniques. The tubing need not completely enclose the sides or surfaces of the trace, and can have a more "C" channel shape.

In other embodiments, the shielding enclosure comprises planar conductive shielding layers positioned adjacent to or on desired sides of the conductive trace. Preferably, at least two planar conductive shielding layers are disposed on opposite sides of the conductive trace. Three planar shielding layers can be positioned to form a "C" shaped enclosure on three sides of the trace, or four can be positioned to surround the trace on four sides, in other embodiments. The shielding layers can be formed from a variety of electrically conductive materials such as copper, brass, silver, or aluminum which are used in plate, tape, foil, or other forms. A plastic or resin like material can also be employed having a conductive coating on a surface thereof, or conductive material imbedded within. The conductive material can be bonded or adhered in place; applied using known material deposition techniques; or applied in a liquid form.

In one embodiment, a layer of non-conductive or dielectric material is deposited or otherwise formed over the antenna trace. A planarizing material may also be used adjacent to or over the trace to from a planar surface for other materials to be bonded to or formed on, as desired. One shielding layer is formed on a surface of the substrate opposite that of the trace, and a second shielding layer is formed on the non-conductive material, effectively sandwiching the trace and substrate between them.

In further embodiments, a conductive surface can be formed between and joining together the two shielding layers discussed above, along either or both of two sides or edges of the trace or substrate. One method of forming this surface is to apply a planar layer of conductive material extending between and coupled to the first and second conductive shielding layers along each side for which enclosure is desired. In an alternative embodiment, a plurality of conductive vias are formed extending through the substrate between and coupled to the first and second conductive shielding layers.

The trace is electrically connected to a conductive pad on one end which interfaces with a signal feed for the antenna, such as a conductive spring or clip type device. In order for the spring to make electrical contact through pressure against the conductive pad, a passage through or around an end of the shielding enclosure is provided. A wall of the enclosure near the conductive pad can have an opening or be made shorter than the trace and conductive pad combination in the area of the pad, to provide appropriate access.

The substrate antenna employs a very thin and compact structure which provides appropriate bandwidth. Antenna compactness and a greater variety of useful shapes allow the substrate antenna to be used very efficiently as an internal antenna for wireless devices. It can be positioned advantageously within a device housing to take advantage of available space in spite of many possible interfering features or structures within the housing.

The shielded substrate antenna concentrates more radiation into a far field region which decreases hand loading and interaction with a wireless device user. In addition, the antenna will not acquire spurious noise when placed near RF and digital circuitry processing communication signals for the wireless device. This improves reception sensitivity of the device.

BRIEF DESCRIPTION OF THE DRAWINGS

The present invention is described with reference to the accompanying drawings, in which like reference numbers generally indicate identical, functionally similar, and/or structurally similar elements, the drawing in which an element first appears is indicated by the leftmost digit(s) in the reference number, and wherein:

FIGS. 10*a* and 10*b* illustrate perspective and cut-away views of one alternative embodiment for the shielded substrate antenna using conductive vias; and FIGS. 10*c*, 10*d*, and 10*e* illustrate cross section and two perspective views, respectively, of alternative embodiments for the shielded substrate antenna of the present invention.

DETAILED DESCRIPTION OF PREFERRED EMBODIMENTS

Figure 1A:
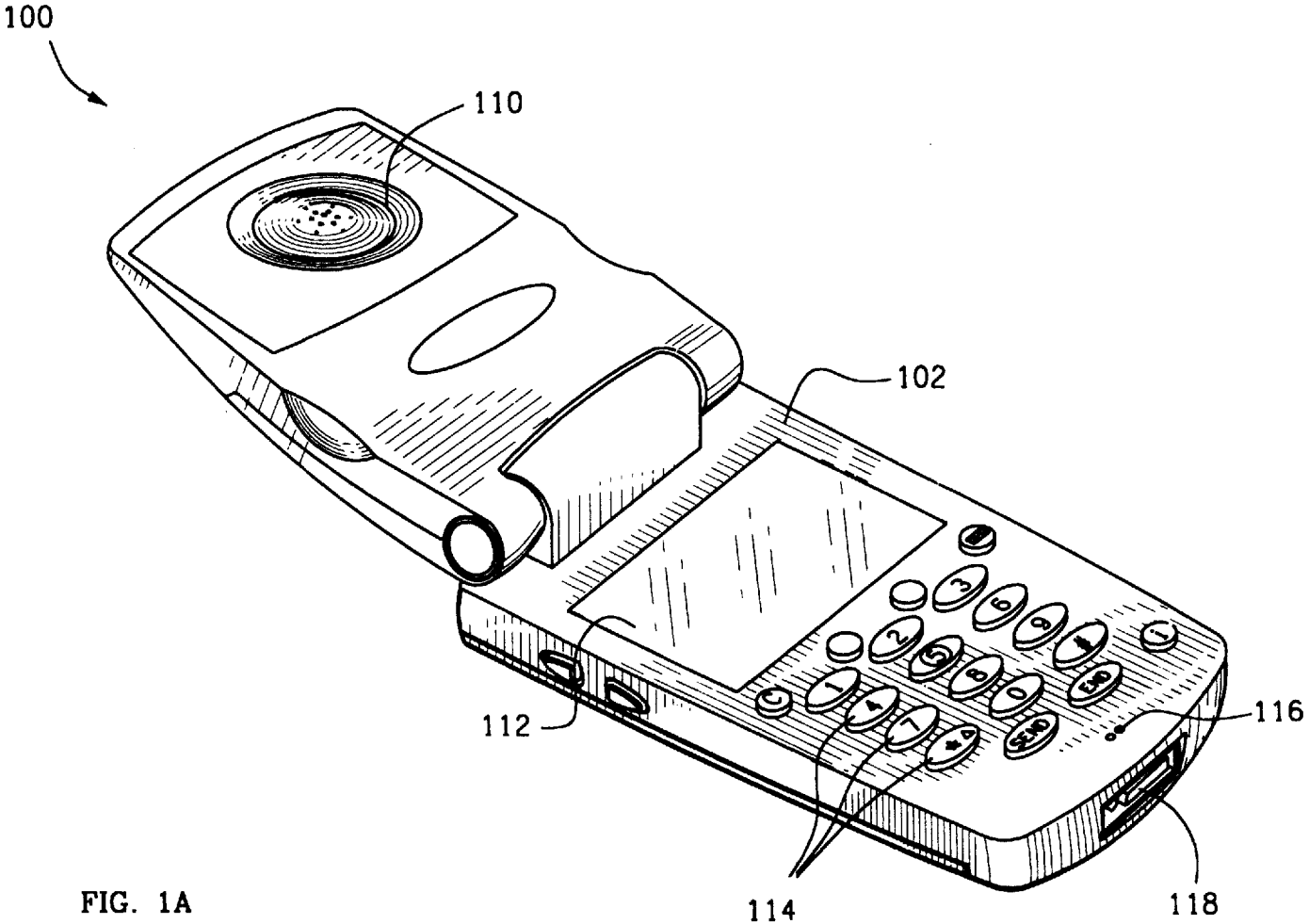
FIGS. 1*a* and 1*b* illustrate perspective and side views of a wireless telephone having a whip and an external helical antenna.

While a conventional microstrip antenna such as the inverted "F" antenna possesses some characteristics that make it potentially usable in personal communication devices, further improvement in other areas is still needed in order to make this type of antenna useful in wireless communication devices, such as cellular and PCS phones. One such area in which further improvement is desired is in bandwidth. Generally, PCS and cellular phones require a bandwidth greater than currently available with microstrip antennas, of practical size, in order to operate satisfactorily.

Another area in which further improvement is desired is the size of a microstrip antenna. For example, a reduction in the size of a microstrip antenna would make a wireless communication device in which it is used more compact and aesthetic. In fact, this might even determine whether or not such an antenna can be used in a wireless communication device at all. A reduction in the size of a conventional microstrip antenna is made possible by reducing the thickness of any dielectric substrate employed, or increasing the value of the dielectric constant, thereby shortening the necessary length. This, however, has the undesirable effect of reducing the antenna bandwidth, thereby making it less suitable for wireless communication devices.

Furthermore, the field pattern of conventional microstrip antennas, such as patch radiators, is typically directional. Most patch radiators radiate only in an upper hemisphere relative to a local horizon for the antenna. This pattern moves or rotates with movement of the device and can create undesirable nulls in coverage. Therefore, microstrip antennas have not been very desirable for use in many wireless communication devices.

A substrate antenna provides one solution to the above and other problems. The substrate antenna provides appropriate bandwidth and a reduction in size over other antenna designs while retaining other characteristics that are desirable for use in wireless communication devices. The substrate antenna can be built near the top surface of a wireless or personal communication device such as a portable phone or may be mounted adjacent to or behind other elements such as support posts, I/O circuits, keypads, and so forth in the wireless device. The substrate antenna can also be built directly into, such as by being embedded within plastic forming a housing, or onto a surface of the wireless device.

Unlike either a whip or external helical antenna, a substrate antenna is not susceptible to damage by catching on objects or surfaces. This type of antenna also does not consume interior space needed for advanced features and circuits, nor require large housing dimensions to accommodate when retracted. A substrate antenna can be manufactured using automation and minimal manual labor, which decreases costs and increases reliability. Furthermore, the substrate antenna radiates a nearly omnidirectional pattern, which makes it suitable in many wireless communication devices.

In a broad sense, the invention can be implemented in any wireless device, such as a personal communication device, wireless telephones, wireless modems, facsimile devices, portable computers, pagers, message broadcast receivers, and so forth. One such environment is a portable or handheld wireless telephone, such as that used for cellular, PCS or other commercial communication services. A variety of such wireless telephones, with corresponding different housing shapes and styles, are known in the art.

FIG. 1 illustrates a typical wireless telephone used in wireless communication systems, such as the cellular and PCS systems discussed above. The phone illustrated in FIG. 1 (1*a* and 1*b*) is a "clam shell" shaped or folding body type phone. This phone is typical of advanced ergonomically designed wireless telephones which are used in wireless communication systems, such as the cellular and PCS systems discussed above. These phones are used for purposes of illustration only, since there are a variety of wireless devices and phones, and associated physical configurations, including this and other types or styles, in which the present invention may be employed, as will be clear from the discussion below.

Figure 1B:
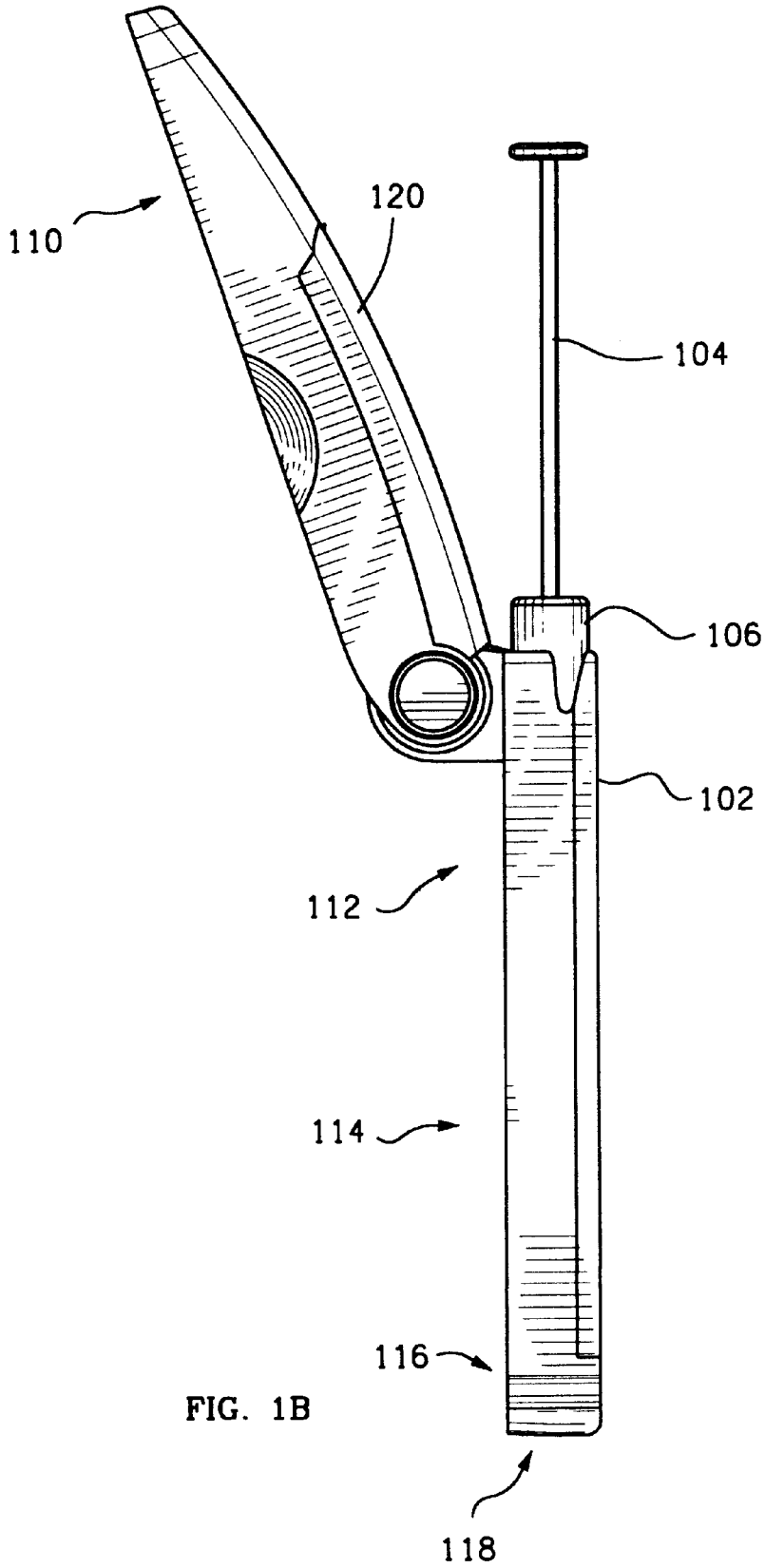

In FIGS. 1*a* and 1*b*, a phone 100 is shown having a main housing or body 102 supporting a whip antenna 104 and a helical antenna 106. Antenna 104 is generally mounted to share a common central axis with antenna 106, so that it extends or protrudes through the center of helical antenna 106 when extended, although this is not required for proper operation. These antennas are manufactured with lengths appropriate to the frequency of interest or of use for the particular wireless device on which they are used. Their specific design is well known and understood in the relevant art.

The front of housing 102 is also shown supporting a speaker 110, a display panel or screen 112, a keypad 114, and a microphone or microphone opening 116, and a connector 118. In FIG. 1*b* antenna 104 is in an extended position typically encountered during wireless device use, while in FIG. 1*a* antenna 104 is shown retracted into housing 102, (not seen due to viewing angle).

As discussed above, whip antenna 104 has several disadvantages. One, is that it is subject to damage by catching on other items or surfaces when extended during use. Antenna 104 also undesirably consumes interior space in such a manner as to interfere with placement of components for advanced features. In addition, antenna 104 may require minimum housing dimensions when retracted that are unacceptably large. Alternatively, antenna 104 could be configured with additional telescoping sections to reduce size when retracted, but would generally be perceived as less aesthetic, more flimsy or unstable, or less operational by consumers. Antenna 106 also suffers from catching on other items or surfaces during use, and cannot be retracted into the phone housing 102. In addition, antenna 106 is highly susceptible to loading or resonant frequency shifting due to contact with a device user's hand.

The use of the present invention is described in terms of this exemplary wireless phone, for purposes of clarity and convenience only. It is not intended that the invention be limited to application in this example environment. After reading the following description, it will become apparent to a person skilled in the relevant art how to implement the invention in alternative environments. In fact, it will be clear that the present invention can be utilized in other wireless communications devices, such as, but not limited to, portable facsimile machines and computers with wireless communications capabilities, and so forth.

Figure 2A:
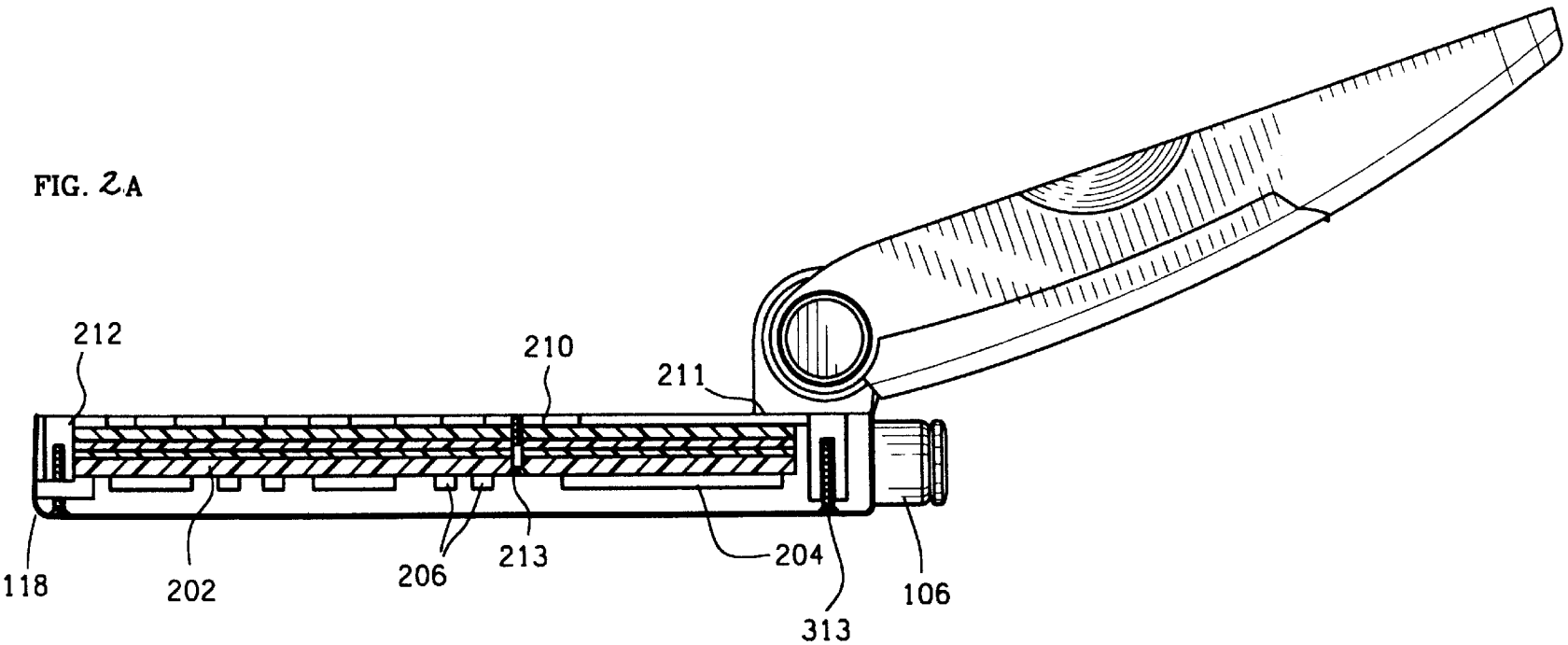
FIGS. 2*a* and 2*b* illustrate side and rear cross sectional views of the telephone of FIG. 1*b* with exemplary internal circuitry.
Figure 2B:
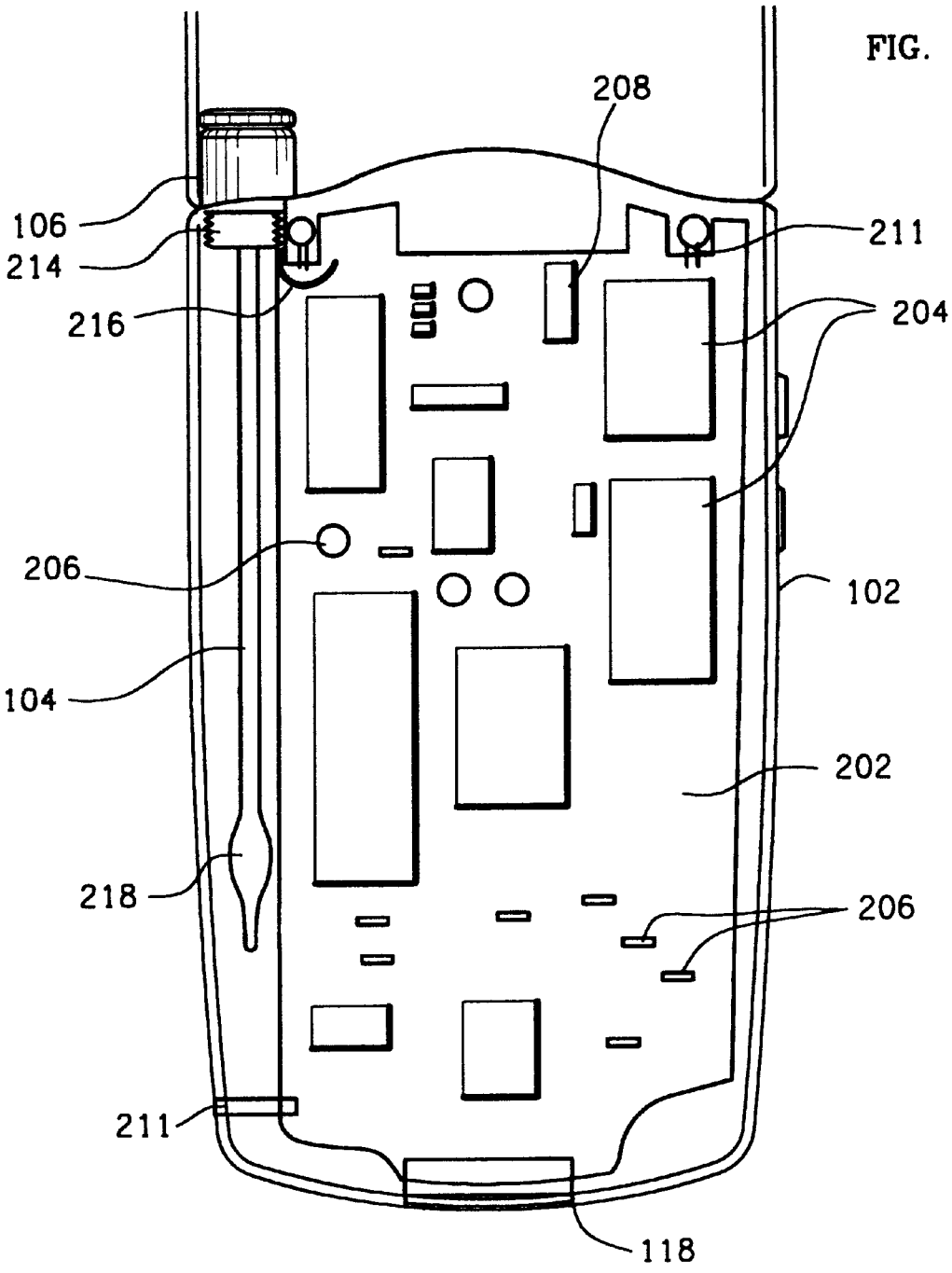

This phone has various internal components generally supported on one or more circuit broads for performing the various functions needed or desired. FIGS. 2*a* and 2*b* are used to illustrate the general internal construction of a typical wireless phone. FIG. 2*a* illustrates a cross section of the phone shown in FIG. 1*b* when viewed from one side, to see how circuitry or components are supported within housing 102. FIG. 2*b* illustrates a cutaway of the same phone as viewed from the back, opposite side to the keypad, to see the relationship of the circuitry or components typically found within housing 102.

In FIGS. 2*a* and 2*b*, a circuit board 202 is shown inside of housing 102 supporting various components such as integrated circuits or chips 204, discrete components 206, such as resistors and capacitors, and various connectors 208. The panel display and keyboard are typically mounted on the reverse side of board 202, with wires and connectors (not shown) interfacing the speaker, microphone, or other similar elements to the circuitry on board 202. Antennas 104 and 106 are positioned to one side and are connected to circuit board 202 using special wire connectors, clips, or ferrules 214 and conductors or wires 216 intended for this purpose.

In a typical phone, a metallic ferrule 214 is used on the bottom of helical antenna 106 to mount that antenna in place on housing 102. The whip antenna is mounted to slid within the helical antenna, using a wider tip on top and an expanded portion 218 on the bottom to constrain it to move within helical antenna 106. Portion 218 of antenna 104 is also conductive and when the antenna is raised, generally makes electrical contact with ferrule 214. Signals are transferred through wire 216 to ferrule 214 and portion 218 to antenna 106.

Typically, a predetermined number of support posts or stands 210 are used in housing 102 for mounting circuit boards or other components within the housing. One or more support ridges or ledges 211 can also be used to support circuit boards. These posts can be formed as part of the housing, such as when it is formed by injection molding plastic, or otherwise secured in place, such as by using adhesives or other well known mechanisms. In addition, there are typically one or more additional fastening posts 212 which are used to receive screws, bolts, or similar fasteners 213 to secure portions of housing 102 to each other. That is, housing 102 is manufactured using multiple parts or a main body portion and a cover over the electronics. Fastening posts 212 are then used to receive elements 213 used to secure the housing portions together. The present invention easily accommodates or accounts for a variety of posts 210 or 212, while still providing a very efficient internal antenna design.

As seen in the enlarged view of FIG. 2*b*, circuit board 202 generally is manufactured as a multiple layer circuit board having several alternating layers of conductors and dielectric substrate bonded together to form a fairly complex circuit interconnection structure. Such boards are well known and understood in the art. As part of the overall structure, board 202 has at least one, and sometimes more, ground layer or ground plane, either on a bottom most surface or embedded within the board at an intermediate position.

It has been recognized that due to the manner in which the antennas in a wireless device excite currents in the ground plane, the larger less useful antennas can be replaced by a smaller more compact antenna element provided it is positioned appropriately with respect to the ground plane of the wireless device. This led to the creation and development of a substrate antenna as disclosed in the copending application discussed above.

Figure 3B:
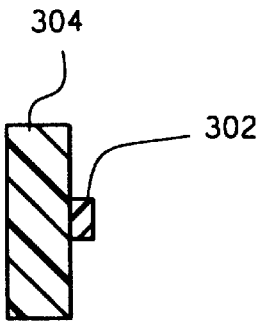
FIGS. 3*a*–3*c* illustrate a substrate antenna found useful in the telephone of FIG. 1.
Figure 3A:
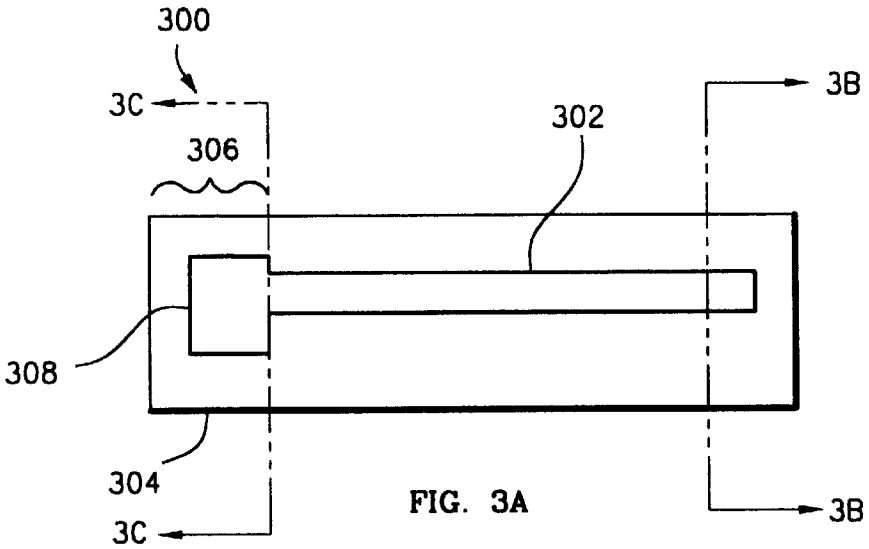
Figure 3C:
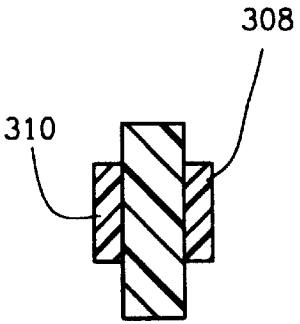

A substrate antenna 300 is shown in the top and side views of FIGS. 3*a*–3*c*. In FIGS. 3*a* and 3*b*, substrate antenna 300 includes a conductive trace 302, also referred to as a strip or elongated conductor, a dielectric support substrate 304 and a signal feed region 306. Conductive trace 302 can be manufactured, or viewed, as more than one trace electrically connected together in series to form the desired antenna radiator structure. Trace 302 is electrically connected to a conductive pad 308 in signal feed region 306 at or adjacent to one end of substrate 304.

Substrate 304 is manufactured from a dielectric material or substrate, such as a circuit board or flexible material known for such uses. For example, a small fiberglass based printed circuit board (PCB) could be used. A variety of materials are available for manufacturing the substrate. Typical commercially available fiberglass, phenolic, plastic, or other printed circuit board or substrate materials can be used. The use of a thin substrate is not required, but provides the advantage of being deformable and easily mounted in place. A very thin Fiberglass reinforced Teflon sheet could be used for very thin substrates which are desired to meander or flex a significant amount. However, such thin material might not provide a rigid enough support to prevent the antenna characteristics from changing with movement of the phone. Those skilled in the art of electronics and antenna design are very familiar with the various products available from which to manufacture an appropriate antenna substrate, based on desired dielectric properties or antenna bandwidth characteristics.

The substrate acts as a means of support and spacing for the antenna radiator element, here the trace, from either other conducting surfaces, or to provide a minimal spacing from hands or other radiation absorbing or interactive material (such as tissue).

The trace is manufactured from a conductive material such as, for example, copper, brass, aluminum, silver or gold, or other conductive materials or compounds known to be useful in manufacturing antenna elements. This could include conductive materials embedded within plastic or conductive epoxies, which can also act as the substrate.

The trace, or traces, may be deposited using one of several known techniques such as, but not limited to, standard photo-etching of a conductive material on a dielectric or insulated substrate; plating or otherwise depositing a conductive material on a substrate; or positioning a conductive material, such as a thin plate of metal, on a support substrate using adhesives or the like. In addition, known coating or deposition techniques can be used to deposit metallic or conductive material on a plastic support element or substrate, which can be shaped as desired.

The length of trace 302 primarily determines the resonant frequency of substrate antenna 300. Trace 302, or a set or series of connected traces, is sized appropriately for a particular operating frequency. Traces used to comprise the antenna are deposited to provide a conductive element that is approximately ¼ an effective wavelength ($\lambda$) for the frequency of interest. Those skilled in the art will readily recognize the benefits of making the length slightly greater or less than $\lambda/4$, for purposes of matching the impedance to corresponding transmit or receive circuitry. In addition, connecting elements such as exposed cables, wires, or the clip discussed below contribute to the overall length of the antenna, and are taken into account when choosing the dimensions of traces, as would be known.

Where substrate antenna 300 is used with a wireless device capable of communicating at more than one frequency, the length of trace 302 is based on the relationship of the frequencies. That is, multiple frequencies can be accommodated provided they are related by fractions of a wavelength. For example, the $\lambda/4$ length for one frequency corresponds to $3\lambda/4$ or $\lambda/2$ for the second frequency. Such relationships for using single radiators for multiple frequencies are well understood in the art.

The thickness of trace, or traces, 302 is usually on the order of a small fraction of the wavelength, in order to minimize or prevent transverse currents or modes, and to maintain a minimal antenna size (thickness). The selected value is based on the bandwidth over which the antenna must operate, as is known in the art of antenna design. The width of trace, or traces, 302 is also less than a wavelength in the dielectric substrate material, so that higher-order modes will not be excited. The total length of trace 302 is approximately $\lambda/4$, but it should be noted that the trace can be folded, bent, or otherwise redirected, to extend back along the direction it came so that the overall antenna structure is much less than $\lambda/4$ in length. The thin conductor dimensions combined with a relatively thin support substrate and less than $\lambda/4$ total length, allows a significant reduction in the overall size of the antenna compared to conventional strip or patch antennas, thereby making it more desirable for use in personal communication devices. For example, compare these dimensions to the ground plane of a conventional microstrip antenna which is typically at least $\lambda/4$ in dimension in order to work properly.

As shown in FIGS. 3*a* and 3*c*, a conductive pad 308 is positioned in signal feed region 306 and electrically coupled or connected to trace 302. Generally, pad 308 and trace 302 are formed from the same material, possibly as a single unified body or structure, using the same manufacturing technique although this is not required. Pad 308 simply needs to make good electrical contact with trace 302 for purposes of signal transfer without adversely impacting antenna impedance or performance.

Figure 5A:
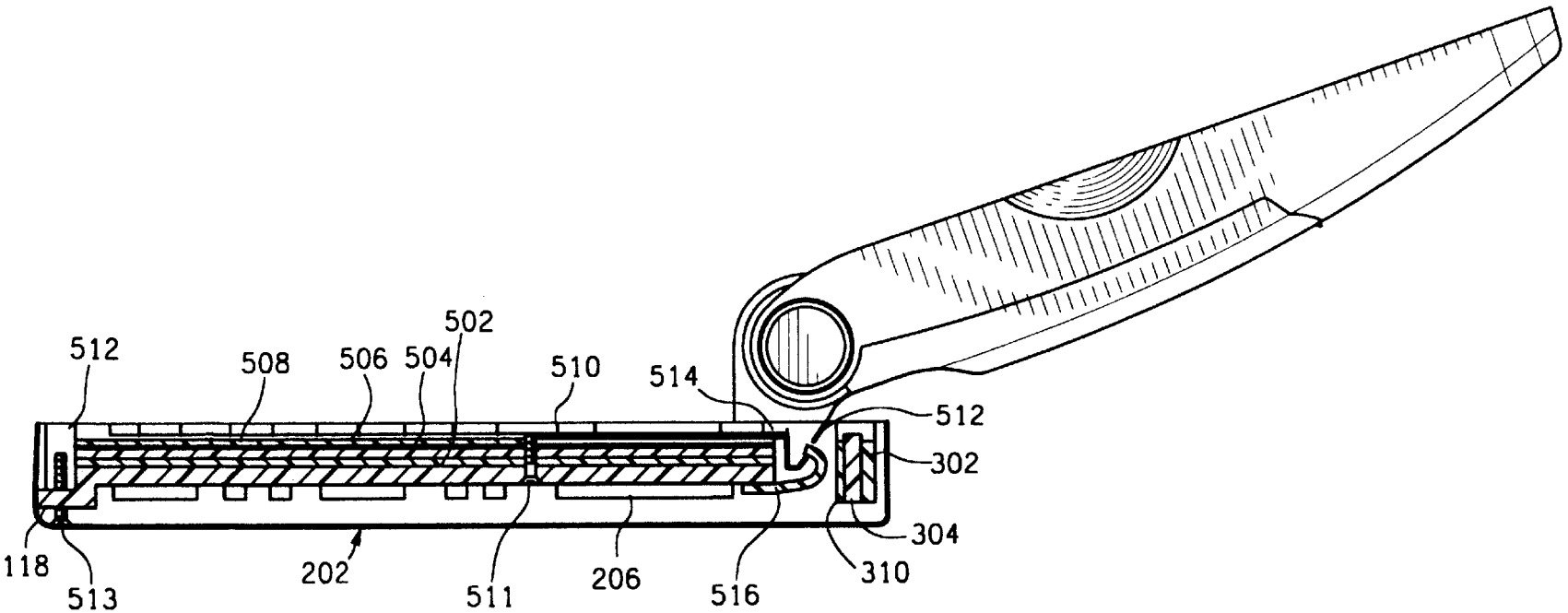
FIGS. 5*a* and 5*b* illustrate side cross sectional and rear views of the phone of FIG. 1*b* using a substrate antenna.

In some configurations, the trace will face a circuit board and signal sources or receivers, and in others it will face away from the board. In this latter situation, the substrate is positioned between the trace and the board. In this situation, conductive pad 308 would be positioned on the wrong side of the substrate for readily accepting a signal directly from a circuit board, without requiring a wire or other conductor to extend around the substrate. This is undesirable as requiring a more complex connection and installation procedure. Therefore, as shown in FIG. 3*c*, a second contact pad 310 may be used on the opposing side of the substrate (as also seen in FIG. 5*a*) and conductive vias used to transfer signals through the substrate.

A signal transfer feed is coupled to substrate antenna 300 using pad 308 (and 310). The use of conductive pad 308 (and 310) allows the antenna to be installed and operated in a manner that provides for convenient electrical connection and signal transfer through "spring" type, or spring loaded, contacts or clips, the structure of which is known in the art. This simplifies construction and manufacture of the wireless device by eliminating a need for manual installation of specialized connectors, or having to manually insert the antenna within a contact structure. This type of electrical connection also means the antenna is conveniently replaceable when needed, either for repair or for upgrade or alteration of the wireless device to another frequency, without requiring de-soldering or working with special connectors, and so forth. As discussed above, the spring contact contributes to the overall length of the antenna or antenna radiator (trace), and is to be taken into account when choosing the dimensions of traces.

The signal feed couples a signal from a signal processing unit or circuitry (not specifically shown) on circuit board 202 to substrate antenna 300. Note that "circuitry" or signal unit are used to refer generally to the functions provided by known signal processing circuits including receivers, transmitter, amplifiers, filters, transceivers, and so forth.

Figure 4A:
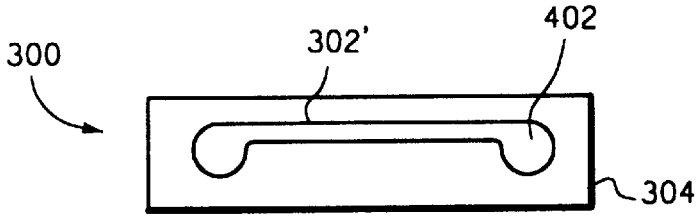
FIGS. 4*a*–4*e* illustrate several alternative substrate antenna embodiments.
Figure 4B:
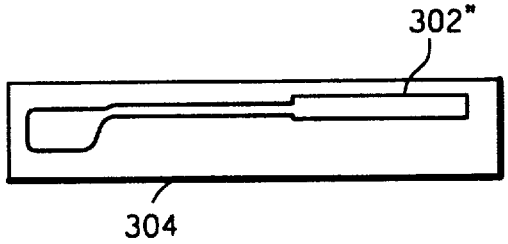
Figure 4C:
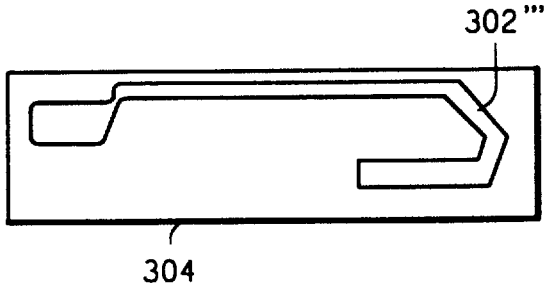

FIGS. 4*a*–4*e* illustrate several alternative embodiments for the traces used in forming an antenna 300 according to the present invention. In FIG. 4*a*, a trace 302' is shown as a single thin conductive strip that extends along the length of substrate 304 (shown in outline), and is connected to or formed with a rounded contact pad 308 on one end, and having an enlarged or rounded portion 402 formed on the non-contact end. This trace has the appearance of a "dog bone". In FIG. 4*b*, a trace 302" is formed as a longer thin conductive strip connected to or formed with a more squared contact pad 308. Here, the strip extends along the length of substrate 304. In FIG. 4*c*, a trace 302'" is formed to also extend along the length of substrate 304 and is then folded or bent near a far non-contact end 404, so that it is redirected back toward the contact pad. This allows the antenna to have a shorter overall length than that of the trace used to form a $\lambda/4$ length element. As stated below, it should be understood that a variety of patterns or shapes can be used in redirecting or folding the trace along different directions. For example, square corners, circular bands, or other shapes can be used for this function, without varying from the teachings of the invention. The trace is also wider in the folded back portion than in the other portion. The increased width, as in FIGS. 4*b* and 4*c*, provides "top loading" or improved bandwidth for the antenna, which will be useful for some applications. However, this extra width is not required by the invention.

Figure 4D:
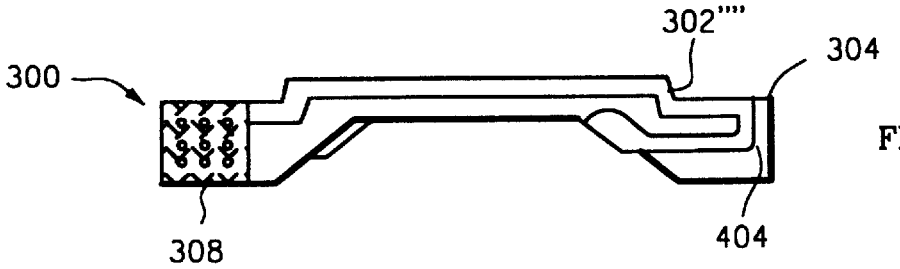

In FIG. 4*d*, a trace 302"" trace assumes a more complex shape following the edge of the substrate which has been manufactured with a tab or protrusion along one edge and a corresponding inset or depression on the opposing edge. Such tabs and other angles and depressions along the length of the substrate serve to interface with the sides or features of the wireless device housing and various support elements. That is, the edges of substrate 304 can be shaped in, or take on a variety of shapes, to fit within a housing. The edges can be shaped to mate with or be positioned around corresponding variations in the walls of the housing and to circumvent various bumps, extrusions, irregularities or known protrusions from surfaces of the housing walls, or to even leave gaps for wires, conductors and cables that need to be placed in the wireless device. The sides or edges of the substrate can use a variety of rounded, square or other shapes for this purpose. Such edges allow the antenna to be mounted in spaces heretofore unsuitable to microstrip antennas. Note a space 406 between the end of the trace where it is folded back and the edge of the substrate. This space or gap with the edge serves to set the trace back and further decrease the impact of a hand coming near, or into contact with, the edge of the antenna.

Furthermore, the shape of trace 302 (302', 302", 302'", 302"") or substrate antenna 300 can also vary in a three dimensional sense. That is, while traces are formed as generally planar surfaces, the substrate, or substrate surface, can be curved or bent to accommodate various mounting configurations. That is, the substrate can be manufactured as a curved or bent structure, variable surface, or simply by being deformed during installation due to its generally thin but strong nature. It will be clear to those skilled in the art that various curves or bends can be used in this dimension. For example, the substrate surface could form a "meandered" pattern of some sort as well.

Figure 4E:
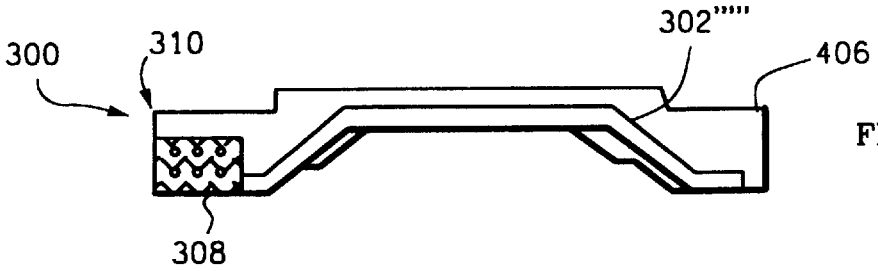

A preferred embodiment for the substrate antenna when used in the phone of FIG. 1, which was constructed and tested, is shown in the front plan view of FIG. 4*e*. Here, substrate 304 was made approximately 52 millimeters in overall length with a trace width of about 1 mm. In this configuration, it was not desired to fold back a portion and the width was substantially uniform without widening. Contact pads 308 and 310 (on the opposing surface) were both made about 4.5×6 mm square with a series of appropriate conductive vias extending through the substrate to connect the two. A fiberglass substrate was used which was about 1 mm in thickness, and the traces and pads were about 0.01 mm thick.

It will be clear to those skilled in the art that a variety of shapes, such as, but not limited to, circular, elliptical, parabolic, angular, and squared C-, L-, or V-shaped folds, joints, and edges can be used for the traces and substrate. The width of the conductors can be changed along the length such that they taper, curve, or stepwise change to a narrower or wider width toward the outer end (non-feed portion). As will be clearly understood by those skilled in the art, several of these effects or shapes can be combined in a single antenna structure.

Figure 5B:
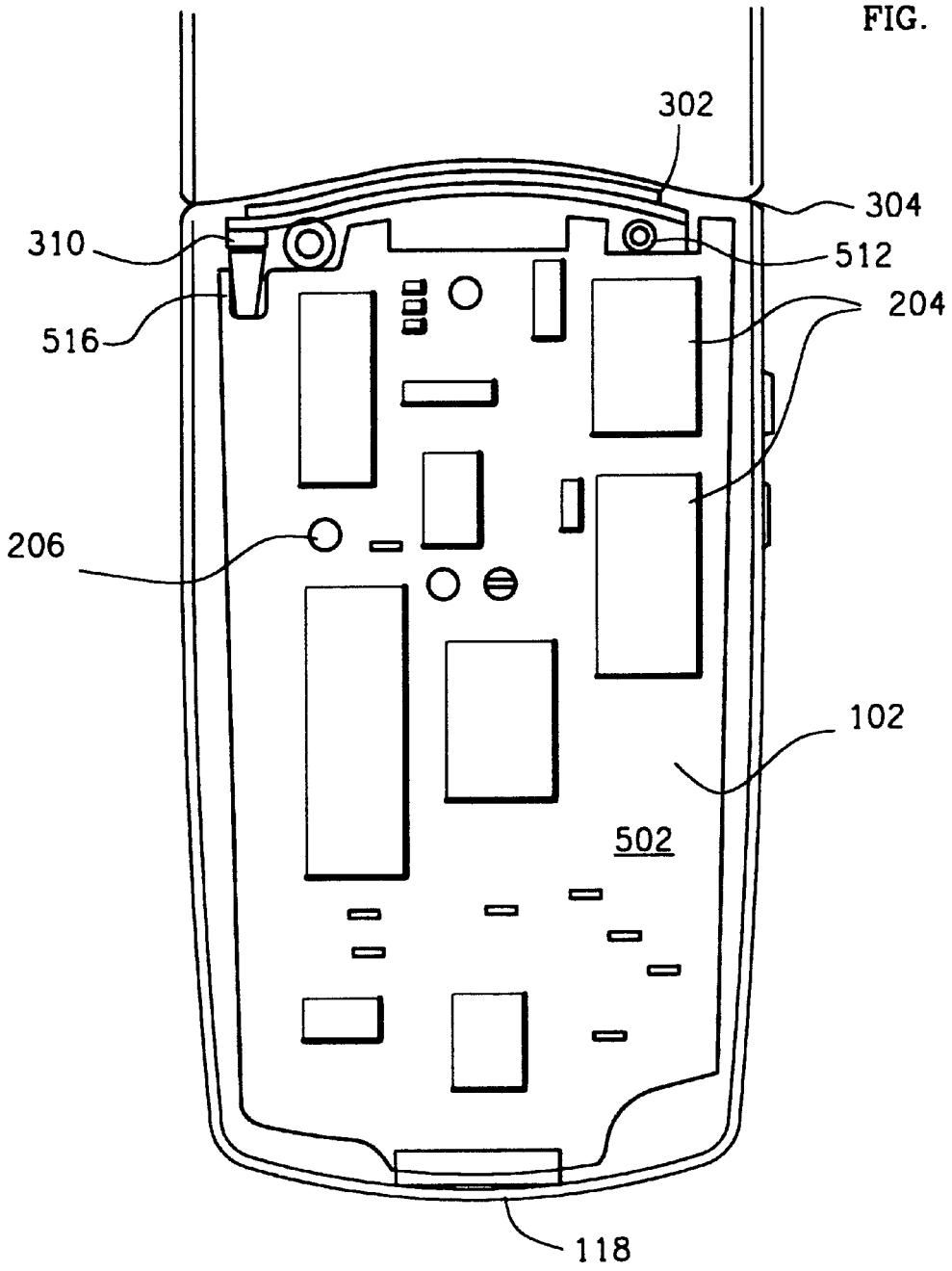

In FIGS. 5*a* and 5*b*, antennas 104 and 106 have been replaced by substrate antenna 300. Circuit board 202 is shown in FIG. 5*a* as comprising multiple layers of conductive and dielectric materials, such as copper and fiberglass, forming what is referred to in the art as a multi-layer board, or a printed circuit board (PCB). This is illustrated as dielectric material layer 502 on top of metallic conductor layer 504 next to dielectric material layer 506 next to or supporting metallic conductor layer 508. Conductive vias (not shown) are used to interconnect various conductors on different layers or levels with components on the outer surfaces Etched patterns on any given layer determine interconnection patterns for that layer. In this configuration, either layer 504 or 508 could form a ground layer or plane, as it is commonly referred to, for board 202, as would be known in the art.

Antenna 300 is mounted adjacent to circuit board 202, but is offset from the ground plane and placed with substrate 304 substantially perpendicular to the ground plane. This arrangement provides a very thin profile for antenna 300, allowing it to be placed in very confined spaces and near the surface of housing 102. For example, antenna 300 can be positioned between fastener or mounting posts 512 and the side (top) of housing 102, something not achievable using conventional microstrip antenna designs.

As before, support posts or stands 510 are used for mounting circuit boards or other components within the housing. One or more support ridges or ledges 514 can also be used to support circuit boards. In addition, there are typically one or more additional fastening posts 512 which are used to receive screws, bolts, or similar fasteners 513 to secure portions of housing 102 to each other, when housing 102 is manufactured using multiple parts. The present invention easily accommodates or accounts for a variety of posts 510 or 512, while still providing a very efficient internal antenna design.

As an option, such posts can now be used to automatically position and support antenna 300 without requiring additional support mechanisms or attachments. Some means of support is needed to position the substrate in place, and this provides for a very simple mounting mechanism reducing labor costs for installation of the antenna and potentially allowing automated assembly. The nature of how the substrate can be mounted in place allows it to simply rest against the housing. The circuit board can also simply rest against the housing using the pressure fit of the display panel or the connector 118 which fit through holes or passages in the housing.

In the alternative, substrate 304 can be secured in place within the wireless device using small brackets, or using posts, bumps, ridges, slots, channels, support extrusions and protrusions, or the like formed in the material used to manufacture the walls of housing 102, to rest the substrate against. That is, such supports are molded, or otherwise formed, in the wall of the device housing when manufactured, such as by injection molding. These support elements can then hold substrate 304 in position when inserted between them, or inside them, or using fasteners attached to them, during assembly of the phone. Ridges or tabs 514 formed in the walls of the housing (or support posts) can "snap" around the edges of boards to assist in holding them in place. Other means for mounting are the use of adhesives or tape to hold the substrate against a side wall or some other portion or element of the wireless device.

As seen in FIG. 5*b*, substrate 304 can be curved or otherwise bent to closely match the shape of the housing or to accommodate other elements, features, or components within the wireless device. The substrate can be manufactured in this shape or deformed during installation. Using a thin substrate allows the substrate to be flexed or bent when installed, and this can place a sort of tension or pressure by the substrate against adjacent surfaces. This pressure can act to generally secure the substrate in place without the need for screws or other types of fasteners. Some form of capturing is then accomplished simply by installing the adjacent circuit board and covers or portions of the housing that are fastened in place.

However, those skilled in the art will readily recognize that there is no requirement to deform or curve the substrate either during manufacture or installation in order for the present invention to operate properly. A straight planar substrate functions very well as the base configuration. Other shapes have the advantage of accommodating various mounting conditions, but do not change the operation of the invention.

With everything resting in place, a back cover or plate for the housing is screwed, bolted, or otherwise fastened in place. This achieves a form of "capturing" of the antenna or substrate within the housing simply by installing the adjacent circuit board and covers or portions of the housing that are fastened in place. Additional fasteners or securing elements are not needed for the antenna in this approach. A set of tabs, or similar protrusions can be used to interface with the cover at some portions to decrease the number of screws needed to hold it in place.

Conductive pad 308 is positioned adjacent to and electrically coupled or connected to board 202 using a spring contact or clip 516. Spring contact or clip 516 is mounted on circuit board 202 using well known techniques such as soldering or conductive adhesives. Clip 516 is electrically connected on one end to appropriate conductors or conductive vias to transfer signals to and from one or more desired transmit and receive circuits used within the wireless device, which are to be coupled to antenna 300. The other end of clip 516 is generally free floating and extends from circuit board 202 toward where antenna 300 is to be placed. More specifically, clip 516 is positioned adjacent to the end of trace 302 where contact pad 308 is located. As shown in the figures, clip 516 is bent in a circular fashion away from the antenna and then in an arch until it is directed back toward the antenna. This circular arch provides a more flexible and simple to work with structure. However, other types of clips, are also known to be useful, and the invention is not limited to this. Spring contact or clip 516 is typically manufactured from a metallic material such as copper or brass, but any deformable conductive material known for this type of application may be used subject to signal attenuation or other desired contact characteristics, as would be known in the art.

Because antenna 300 is not positioned over or parallel with and immediately adjacent to a ground plane, such as layer 504, the antenna has or maintains a sufficiently large radiation resistance. This means that it is possible to provide appropriate matching for antenna 300 without incurring significant losses, that is, the antenna has a good matching impedance. This efficiency is maintained even if antenna 300 is moved to various positions offset to one side of circuit board 202, that is, it is moved laterally but not closer to board 302. This antenna design acts as a very efficient means to excite the ground plane, without compromising performance.

The substrate is not required to be perpendicular to the ground plane but a major feature of a substrate antenna is the small size and an ability to use minimal space. If the substrate is placed in the same plane and parallel to the ground plane, it would clearly occupy more space between the housing and the ground plane. This is less desirable. However, that orientation of the substrate does not prevent the antenna from being operational. Conventional patch antennas must be used in this matter and it is one reason they consume too much space. The present invention differs in that it can use such a smaller amount of lateral space in the wireless device by being placed on edge or its side relative to the ground plane direction.

By locating the antenna adjacent to and above or beyond the edge of the ground plane relative to the housing, the antenna provides a very omnidirectional pattern, more so than a conventional whip antenna. This positioning of the antenna also means that the resulting radiation pattern is substantially vertically polarized as desired for most wireless communication devices.

The substrate is not positioned "over" or "under" the ground plane for the electronics in the wireless device, because in that position, as discussed earlier, the impedance would be adversely affected along with performance. It is important to not have the antenna over the ground plane. This can be expressed in several ways. For example, there is a volume or space positioned above the surfaces of the ground plane which occupies the entire ground plane up to its edges (bounded by edges). This volume is an exclusion zone or area for the substrate. Locating the trace within this volume implies being positioned over the ground plane. From another point of view, any elevation or offset angle between the plane of the ground plane and the position of the substrate antenna. its plane, cannot be 90 degrees. In fact, it should be substantially less than 90 degrees to assure appropriate or sufficient separation from the ground plane.

Another way to look at the antenna, and therefore substrate, positioning is to look at the advantages created by this design. This antenna can be mounted between the ground plane and a side wall (or top or bottom, depending on the point of view) near a top portion of the wireless device. In the case of the folding phone, the antenna can be mounted near the hinge or rotating or pivoting joint between two portions. This provides a position for the antenna that is farther removed from the user, such as user's head, during use owing to the nature of how the phone unfolds, and that joint is positioned. This is a distinct advantage in terms of head absorption and the like. For a "bar" shaped phone or wireless device, the substrate antenna can be mounted near a top or side surface as desired.

The substrate antenna provides for a configuration that allows use of these spaces or regions, and in essence is a new method of utilizing the space, volume or regions of wireless devices adjacent to circuit boards and housings, offset from the ground plane. This structure thus provides a new type of internal antenna mountable within a region immediately laterally adjacent to a ground plane.

An advantage of the invention is that it does not require removing part of the ground plane or circuit board, either to be mounted or positioned in place. Large patch antennas or elements require so much real estate or area that they need part of the circuit board removed, or circuits moved, to have a place for mounting. Another aspect of such antennas is that they are generally mounted to be aligned within the plane of the ground plane. That is, the antenna radiators are formed in a planer configuration (even if they meander) and their -planar axis is aligned to that of the ground plane, which leads to excessive use of space by the antenna, defeating part of the object of using an internal antenna, loss of space.

It should be understood that a portion of trace 302 shown in FIGS. 3 and 5 is considered to be more sensitive to changes in effective resonant length. This portion is most likely to exhibit changes in antenna resonance from the presence of a wireless device users hand or head. There are three main energy losses impacting the operation of antenna 300 in a wireless device. These are impedance mismatch loss caused by dielectric loading of a user's hand, user head absorption, and user hand absorption. Such energy absorption or mismatch loss can degrade performance. For example, hand or head absorption can significantly attenuate signals being used by the wireless device, thus, degrading performance.

The portion of antenna 300 most sensitive to these effects is the open, non-feed, end and adjacent bent sections of trace 302. This portion of the antenna can be located or positioned within the phone housing such that a user's hand will make the least contact or maintain a significant spacing with the hand. This antenna design allows the flexibility in placement within the wireless device to minimize hand absorption, and more importantly to decrease the mismatch loss that can be created by the presence of a hand or other items adjacent to an antenna (except when such a shift is desired).

Another aspect of the small antenna size and flexibility in placement is the impact it can have on energy levels present near a device user. The smaller size and flexible configuration of the antenna affects the placement of the antenna in the housing, which in turn can greatly impact radiation levels experienced at particular locations outside of the device.

Figure 6:
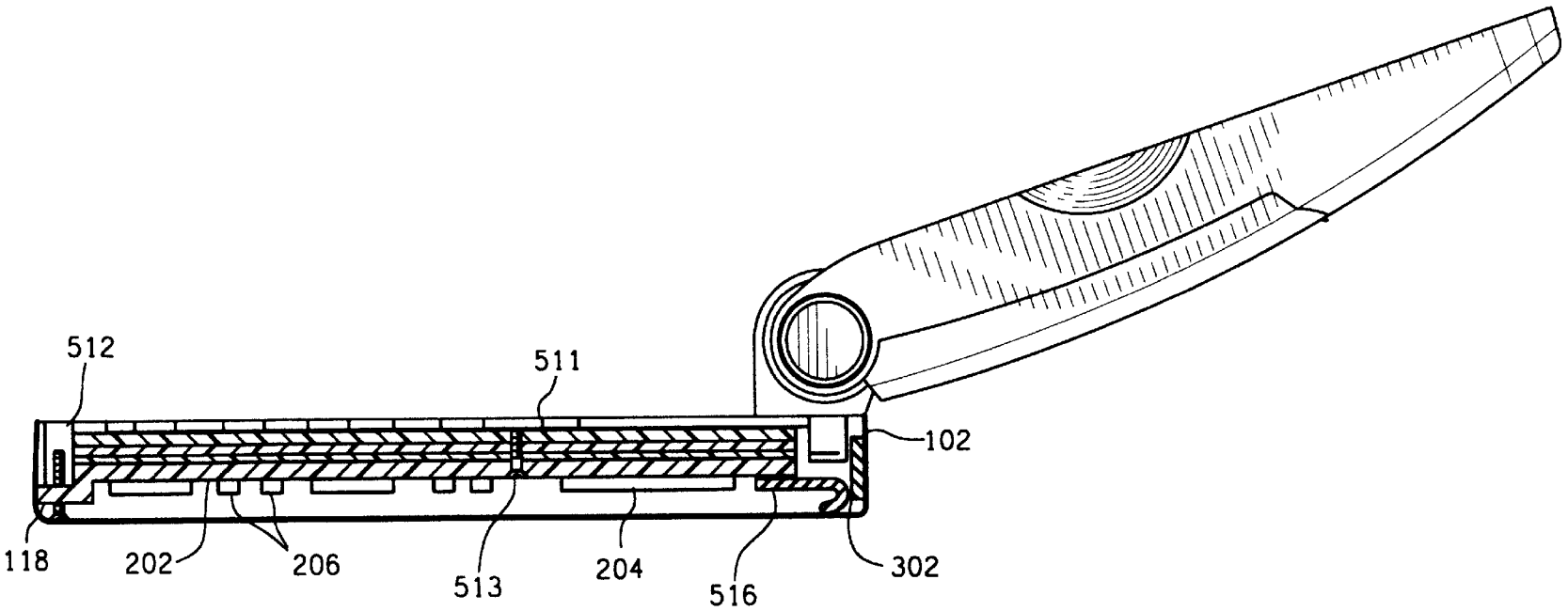
FIG. 6 illustrates a side cross sectional view of the phone of FIG. 1*b* using an alternate embodiment of a substrate antenna.

To further assist in reducing the antenna size or in allowing flexible placement within housing 102, the antenna can also be formed by positioning or depositing conductive material on the housing or a surface within the wireless device. That is, for applications where there is a relatively clear or unobstructed path along a housing side wall, the trace can be deposited or formed right on the wall. This is shown in the cross sectional side view of FIG. 6. In FIG. 6, trace or traces 302 are disposed directly on the housing which acts as a support substrate. This uses a very minimal amount of space.

Where the portion of the housing wall to be used is metal coated or is manufactured from a metallic or other electrically conductive material, an intermediate layer of insulating material can be used between the housing and traces 302. In this configuration, a metallic layer having the desired trace configuration could be formed on a thin layer of material having an adhesive backing which allows easy placement in the wireless device by simple pressure against the side of the housing. This step could even be automated using "pick and place" machinery known in the art. The trace in this or any embodiment can use further coatings or such, as known in the art, for surface protection.

However, it will be clear to those skilled in the art, the relative positioning of the antenna or conductive material relative to the ground plane should be the same as discussed above, in terms of not being over the ground plane.

Unfortunately, when used in some wireless devices, such as the phone of FIGS. 1*a*–1*b*, the substrate antenna tends to exhibit more resonant imbalance sensitivity or hand loading than desired. That is, although the antenna can be positioned to minimize the impact of hand loading, additional reduction of loading is desired for improved operating characteristics in many applications. At the same time, when placed near outer surfaces of the wireless device, the antenna can also concentrate more radiation along a direction toward a device user than desired. This could appear as an excessive amount of radiation when tested under governmental standards testing for consumer use. In addition, a typical placement for substrate antennas is near RF and digital circuitry processing communication signals for the wireless device. This may cause the antenna to acquire spurious noise signals from such sources, which in turn can degrade the reception sensitivity of the device.

In order to solve these problems in certain wireless device configurations, a new substrate antenna has been created using shielding or a shielding enclosure that suppresses near-field radiation and noise from nearby circuitry. A new substrate antenna 700 constructed according to the present invention is illustrated in the plan views of FIGS. 7*a*–7*d*.

Figure 7A:
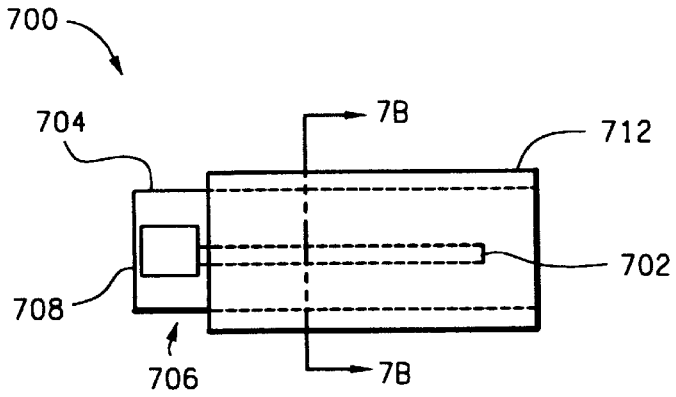
FIGS. 7*a*–7*c* illustrate a shielded substrate antenna constructed according to the present invention.
Figure 7B:
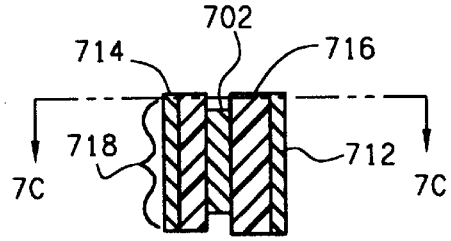
Figure 7C:
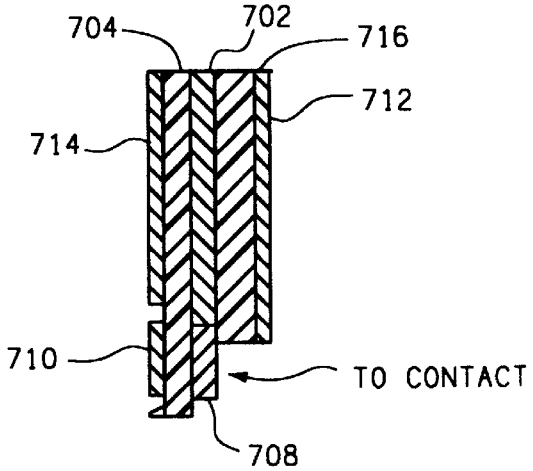
Figure 7D:
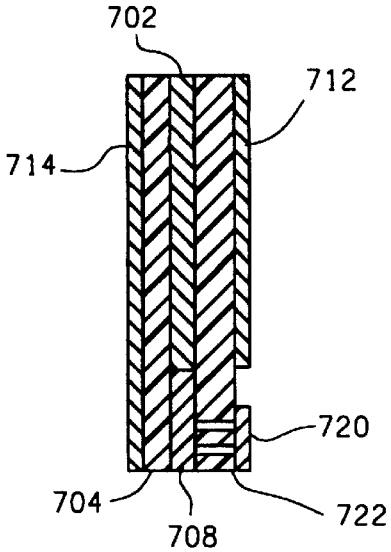
FIG. 7*d* illustrates an alternative embodiment for the shielded substrate antenna of FIGS. 7*a*–7*c;*

In FIGS. 7*a*, 7*b*, and 7*c*, substrate antenna 700 includes a conductive trace 702, also referred to as a strip or elongated conductor, a dielectric support substrate 704 and a signal feed region 706. As before, conductive trace 702 can be manufactured, or viewed, as more than one trace electrically connected together in series to form the desired antenna radiator structure. There is also no limitation as to having a single trace on a single support substrate layer. That is, multiple traces having a variety of shapes and residing on different layers of a support substrate to form more complex substrate antenna shapes, as desired, are within the teachings of the present invention. The present invention is not limited to shielding a single trace on one layer or surface. Trace 702 is electrically connected to a conductive pad 708 in signal feed region 706 at or adjacent to one end of substrate 704.

Substrate 704 is manufactured from a dielectric material or substrate, such as a circuit board or flexible material known for such uses. Those skilled in the art of electronics and antenna design are very familiar with the various products available from which to manufacture an appropriate antenna substrate, based on desired dielectric properties or antenna bandwidth characteristics, strength, and flexibility.

The trace is manufactured from a conductive material such as, for example, copper, brass, aluminum, silver or gold, or other conductive materials or compounds known to be useful in manufacturing antenna elements. This could include conductive materials embedded within plastic or conductive epoxies.

The trace, or traces, may be deposited using one of several known techniques such as, but not limited to, standard photo-etching of a conductive material on a dielectric or insulated substrate; plating or otherwise depositing a conductive material on a substrate; or positioning a conductive material, such as a thin plate of metal, on a support substrate using adhesives or the like. In addition, known coating or deposition techniques can be used to deposit metallic or conductive material on a plastic support element or substrate.

As shown in FIGS. 7*b* and 7*c*, substrate antenna 700 also includes a first shielding layer 712 and a second shielding layer 714 on either side of conductive trace 702, also including additional dielectric material 716.

First shielding layer 712 and second shielding layer 714 are generally manufactured from a conductive material such as, for example, copper, brass, aluminum, silver or gold, or other conductive materials or compounds known to be useful in manufacturing antenna elements. This could include conductive materials embedded within plastic or conductive epoxies. In addition, for some applications, a multilayered ceramic and conductive element structure might be used. There is no requirement for the material forming shielding layers 712 and 714 to be the same as that forming conductive trace 702. In some applications it may be more appropriate or desired to make trace 702 out of a very low loss material, but make the shielding layers out of a higher loss material, which also is easier to solder or otherwise connect to, or more robust and resistant to abuse. Where desired additional insulating or protective material layers 718, such as lacquer or insulating tape, could be disposed over the shielding layers for physical protection.

Dielectric material 716, as in the case for substrate 704, is also manufactured from a dielectric material or substrate, such as a printed circuit board or flexible material known for such uses. Those skilled in the art of electronics and antenna design are very familiar with the various products available from which to manufacture an appropriate antenna substrate, based on desired dielectric properties or antenna bandwidth characteristics.

First shielding layer 712 and second shielding layer 714 are configured to be at least the same size as trace 702. The dimensions need not have an exact relationship to trace 702, but should be as wide and long in order to intercept a significant amount of energy or radiation emanating from the trace. That is, to adequately ground or short out energy in the near field of trace. It is preferred that the shielding layers be as large in relation to the traces as possible. However, like substrate 704, the shielding layers are generally limited in size by the physical constraints placed on antenna 700. The shielding layers cannot be any larger than the area allocated within the wireless device, which is generally the same size as substrate 704, although more space might be available.

First shielding layer 712 and second shielding layer 714 act to reduce the fields to zero for the near field of the antenna. These shields represent a grounded potential and as such do not support currents or radiation patterns. Therefore, when the near field radiation is observed or intercepted by nearby objects or a user, it has a lower power level than before. This is useful in radiation testing and in meeting or exceeding test standards.

In FIG. 7*c*, one end of substrate 704 extends beyond at least one of the shielding layers so that either pad 708 or a pad 710 on the reverse side of the substrate can be easily contacted. This is seen in the side view of FIG. 7*c*. However, for purposes of simpler manufacturing, the end of substrate 704 having pad 708 does not extend beyond either of the shielding layers so that each layer of dielectric and shielding material can be deposited or formed as a uniform width material, although this is not required. In order to transfer signals to or from the antenna trace, another conductive pad 720 is formed on one of the shielding layers, typically from the same material as the shielding. A series of one or more conductive vias 722 are formed in the appropriate dielectric material or substrate to contact conductive pad 708 below the new pad 720. Pad 720 is then used to contact clip 516 or other connectors used for transferring signals to the antenna. This latter configuration is illustrated in the side view of FIG. 7*d*.

Figure 8A:
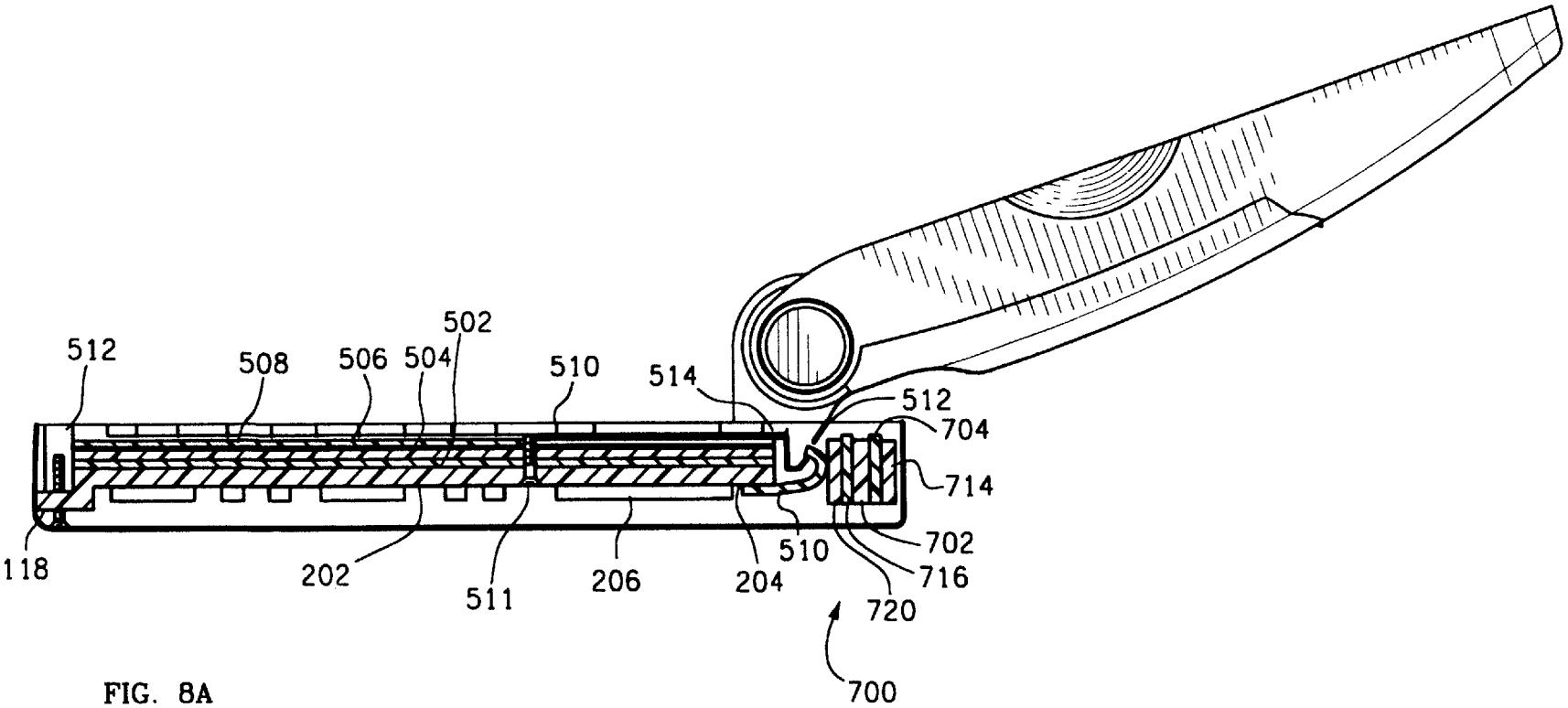
FIGS. 8*a* and 8*b* illustrate side cross sectional and rear views of the telephone of FIG. 1*b* using the present invention.
Figure 8B:
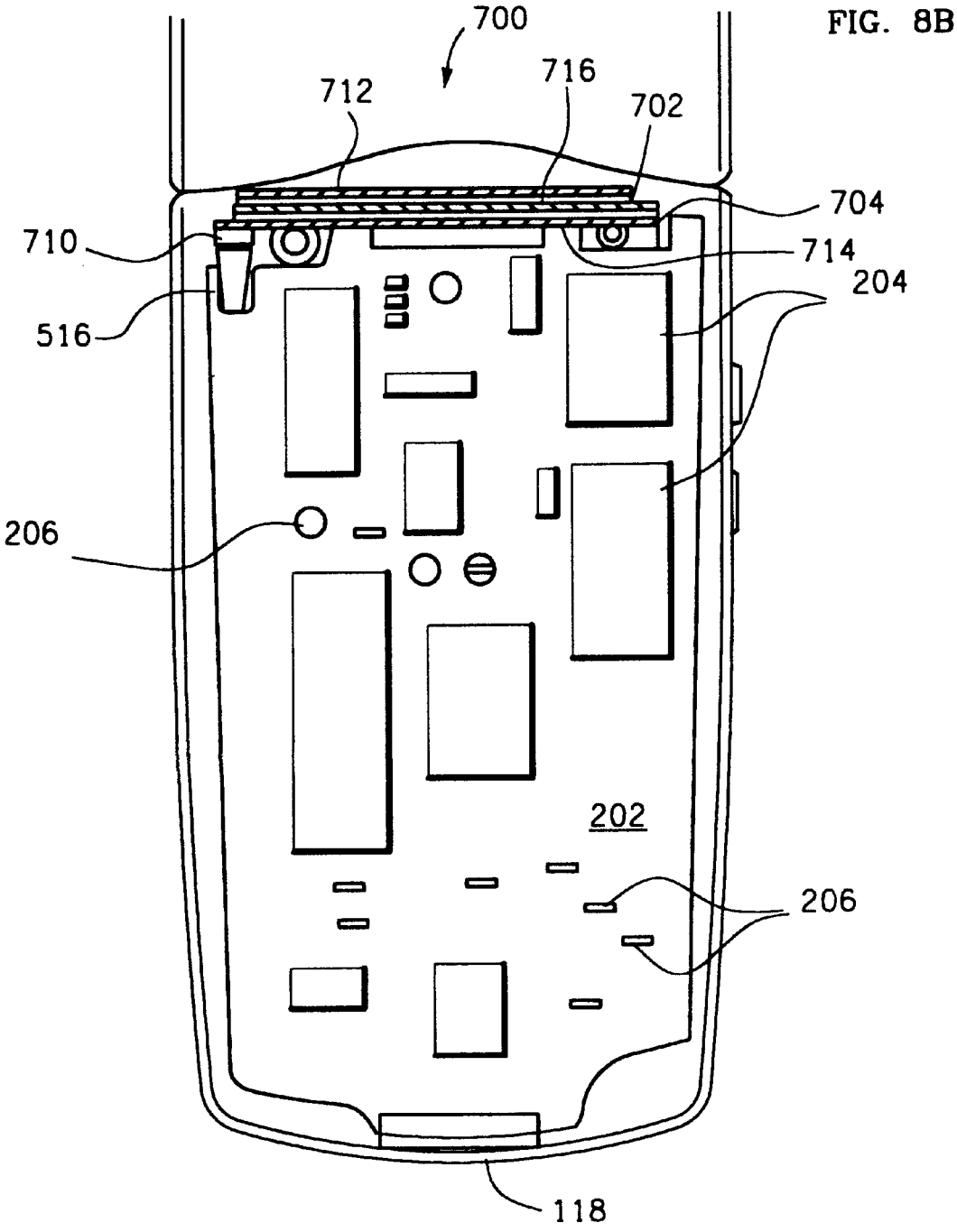

In FIGS. 8*a* and 8*b*, antennas 104 and 106 have been replaced by substrate antenna 700. Antenna 700 is mounted adjacent to circuit board 202, but is offset from the ground plane and placed with substrate 704 substantially perpendicular to the ground plane. In this embodiment, antenna 700 has a fairly straight or non-curved profile. This arrangement provides a very thin profile for antenna 700, allowing it to be placed in very confined spaces and near the surface of housing 102. For example, antenna 700 can be positioned between fastener or mounting posts and the side (top) of housing 102. Such posts can be used to automatically position and support antenna 700 without requiring additional support mechanisms or attachments. This provides for a very simple mounting mechanism reducing labor costs for installation of the antenna and potentially allowing automated assembly.

In the alternative, as before, substrate 704 can be secured in place within the wireless device using small brackets, posts, bumps, ridges, slots, channels, or the like formed in the material used to manufacture the walls of housing 102. That is, such supports are molded, or otherwise formed, in the wall of the device housing when manufactured, such as by injection molding. These support elements can then hold substrate 704 in position when inserted between them, or inside them, during assembly of the phone.

Figure 8C:
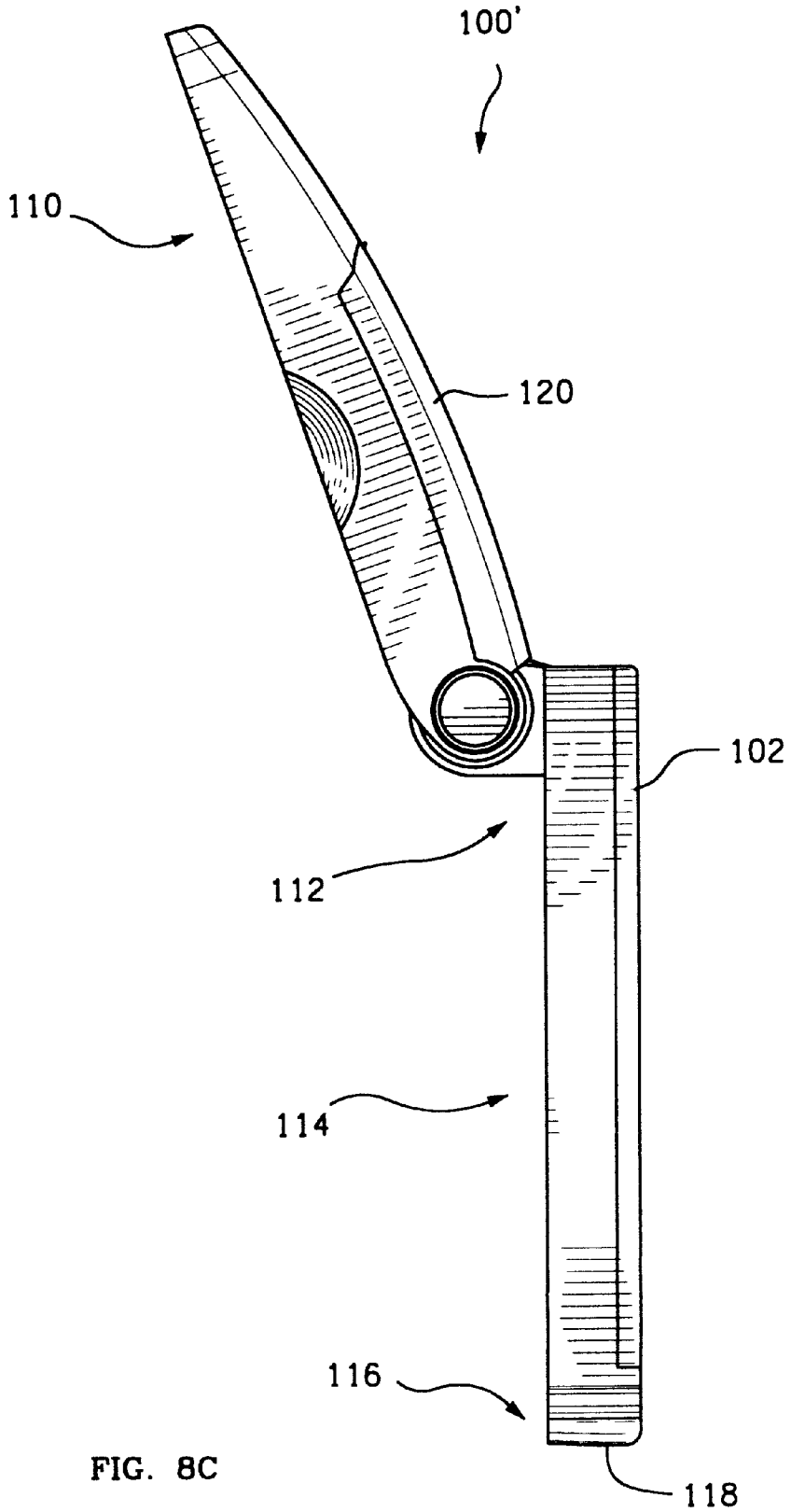
FIG. 8*c* illustrates a side plan view of the phone of FIG. 1*b* using the present invention.

The result of removing both whip antenna 104 and helical antenna 106 is readily apparent in the side plan view of FIG. 8*c* which shows the phone of FIG. 1*b* using the present invention.

Figure 9:
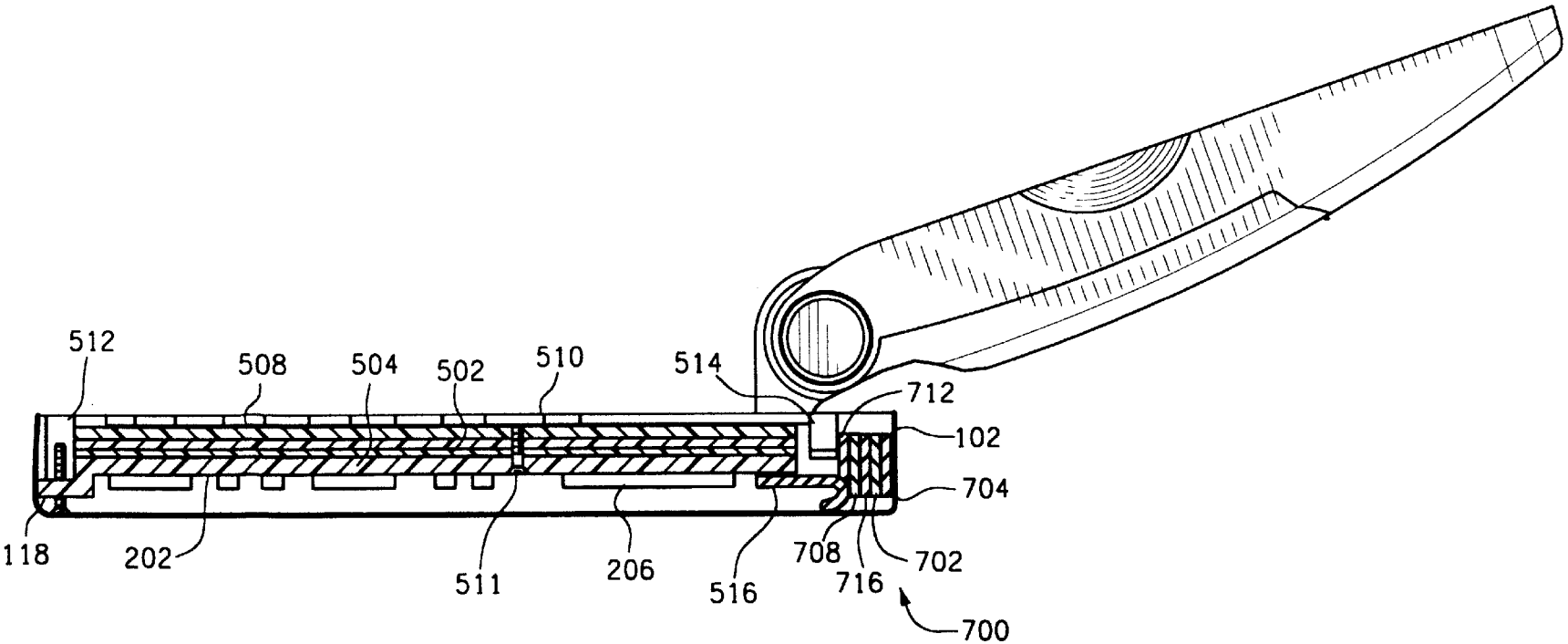
FIG. 9 illustrates an alternative embodiment for the shielded substrate antenna of FIGS. 7*a*–7*c*, when used in telephone of FIG. 1*b;*

Alternatively, each of the layers of material forming antenna 700 can be formed on the walls of the wireless device housing. That is, a layer of insulating material would be formed, unless the housing is non-conductive, then a layer of metallic or conductive material, then a dielectric, then the trace or traces and conductive pad, the additional dielectric material, and finally another shielding layer. This configuration is illustrated in FIG. 9.

Conductive pad 708 is positioned adjacent to and electrically coupled or connected to board 202 using spring contact or clip 516 mounted on circuit board 202 using well known techniques, as discussed before. More specifically, clip 516 is positioned adjacent the end of trace 702 where contact pad 708 is located. Clip 516 transfers signals to and from one or more desired transmit and receive circuits used within the wireless device, which are to be coupled to antenna 700.

Antenna 700 is not positioned over ground plane 504, and the antenna has or maintains a sufficiently large radiation resistance, making it possible to provide appropriate matching without incurring significant losses, that is, the antenna has a good matching impedance. This efficiency is maintained even if antenna 700 is moved to various positions offset to one side of circuit board 202, that is, it is moved laterally but not closer to board 202.

The shielding layers act to decouple a user's hand from the antenna. That is, the shielding minimizes or greatly reduces hand loading by presenting a "zero" field between the hand and the trace. As stated above, the shields create a area of "zero" or "zero level" field near the antenna. That means that there is no field for the hand to interact with or substantially influence, which would alter antenna performance. The field energy essentially escapes from the end of the trace near the end of the substrate between the shielding. This provides a significant far field energy level which controls the communication capabilities for the wireless device.

A very low to zero level near field energy also means that radiation measurements for exposure near the wireless device, such as immediately adjacent to the device where a user's head would naturally tend to be, should also be very low. Therefore, the shielding layers redirect energy into a far field pattern for communications and away from hands or other body parts positioned next to the device.

A preferred embodiment for the shielded substrate antenna was constructed and tested based on the front plan view of FIG. 4*d*. As before, substrate 304 was made approximately 52 millimeters in overall length with a trace width of about 1 mm, expanding to about 1.5 mm, and thickness of around 0.01 mm. The contact pads were about 6.75 mm square with a series of appropriate interconnecting conductive vias. A two layer fiberglass substrate was used with the trace supported or sandwiched between the two, with each layer being about 0.5 mm thick. A layer of conductive material, here copper, was deposited on the opposite sides of each substrate layer from the trace, covering the entire substrate on one side and all but a region for conductive pad 410 on the other. Tests indicate that the device functioned as planned.

A further improvement in establishing a zero level near field for antenna 700, is to more substantially "surround" or "enclose" trace 702 with conductive material. That is, to position, form, or dispose conductive shielding material along the two long side edges of the substrate antenna to extend between the material forming the first and second shielding layers (712, 714). This conductive material in combination with the other layers forms a rectangular channel or squared cylindrical housing or enclosure structure in which the substrate antenna resides, with just the two ends of the substrate antenna being free of conductive material. This type of structure appears to assure a more complete direction of energy into the far field of the antenna and out of the near field. This decreases the impact of local hand loading interactions. At the same time, this shielding structure more completely suppresses reception of signals from RF or digital processing circuitry in close proximity to the antenna, and provides a more sensitive antenna.

In FIGS. 10*a* and 10*b*, a shielded substrate antenna 1000 is shown in an exploded perspective view, and in cross section, respectively. Antenna 1000 is constructed in the same manner as discussed above for antenna 700, and is shown having a folded trace 1002 supported by a dielectric substrate 1004. A second layer of dielectric material 1006 is shown positioned above trace 1002, and would normally be formed or otherwise deposited over the trace. In some embodiments, additional material may be deposited on substrate 1004 adjacent to or around trace 1002 to "planarize" the surface of this layer. That is, additional material, in the form of a dielectric substance, may be used to provide a planer layer of material containing trace 1002 for purposes of interfacing with or forming layer 1006 over the trace, as is well known in the electronics art.

First and second shielding layers 1012 and 1014 are shown formed or positioned adjacent to substrate 1004 and material 1006, respectively. Trace 1002 is connected on one end to contact pad 1008. A series of conductive vias 1016 are formed along each side, near the outer edges, of substrate antenna 1000, extending from shielding layer 1012 to shielding layer 1014. Such conductive vias positioned to traverse through layers of dielectric materials or substrates are well understood in the art, and their manufacture is not explained in further detail herein. The vias can be extended as holes or passages through the shielding layers with a conductive coating. Such vias can be electrically connected to the shielding layers using the known material plating or soldering techniques. For example, such techniques are used to connect pads 308 or 708 and 310 or 710 using conductive vias as described above. In the alternative, other known conductive compounds can be used to connect the vias to surfaces of the shielding layers.

The vias can also be completely filled with conductive material to be flush or even extend slightly beyond the outer surfaces of dielectric layers 1004 and 1006. The material forming the shielding layers can be abutted or deposited over the ends of the conductive material to provide appropriate electrical contact. This and other known techniques can be used to provide a series of vias coupling the two shielding layers (1012, 1014) together.

The vias can be positioned in any one of several patterns along the edge of the antenna. The vias could be positioned in a substantially straight line, as staggered pairs along the edge, or even with somewhat random spacing or position. The preferred placement is such that the vias are not spaced any farther apart near the edge than about one-quarter of the wavelength of interest, in order to inhibit passage of radiation out of the antenna. The spacing or position of the vias is such that a virtual conductive wall is created for intercepting or blocking the radiation of interest, that shorts the two shielding layers together.

In FIG. 10*c*, the side or edges of antenna 1000 are covered with a planar layer of conductive shielding material 1020, shown as shielding side layers 1020*a* and 1020*b*. These layers contact and extend between the other shielding layers (1012,1014). Here, the same or other conductive materials as that used to create the shielding layers can be deposited using the same or similar techniques. Alternatively, conductive material in the form of thin plates, strips, or tapes can be secured in place using adhesives or by soldering to the other shielding layers. The side layers can be manufactured to overlap the edges or top of the other layers to assist in this process, as desired. Conductive coatings could be used such as materials in liquid form deposited or brushed on the sides of the substrates forming antenna 1000. For example, this could include epoxies or resins containing conductive fillers, which can be applied to the entire outer surface of the substrates to form all of the shielding layers as a unified structure. In any case, the thickness of the conductive materials is sufficient to prevent penetration or leakage of the radiation being blocked.

In an alternative embodiment for the invention, a separate shielding structure or enclosure can be manufactured and then antenna 700 installed within that structure. This is useful where a particular substrate antenna design is used without shielding layers in some applications and with shielding in others. For example, a rectangular cross section tubing type or "C" shaped channel element with conductive walls can be made in which the substrate antenna is then mounted. This type of structure is illustrated in the perspective views of FIGS. 10*d* and 10*e*.

In FIG. 10*d*, conductive material is used to form a tube or closed channel 1030, having a rectangular cross section, for receiving a substrate antenna 300 and providing the desired shielding. Here a thin metallic plate or other conductive material is folded to form tubing 1030. However, other materials and shapes can be used in forming tubing 1030. For example, the cross section can have a more rounded, oval, square, elliptical, or even triangular or irregular shape, in order to fit within desired manufacturing techniques or to fit within certain spaces or support structures within the wireless device.

In FIG. 10*e*, conductive material is used to form a "C" shaped channel 1032 having an opening 1034 along one side, for receiving the antenna and providing the desired shielding. Here a thin metallic plate or other conductive material is folded to form a rectangular channel 1030. However, as in the case of tubing 1030, other shapes, such as circular with a gap, can be used. In addition, the open side 1034 of the enclosure or channel 1032 can be positioned along one of the larger surfaces of antenna. If one of the major sides or surfaces is left open, it can be placed against a sidewall of housing 102 which is coated with conductive material, or is made form conductive material, to form a desired shielding layer for that side, as in FIG. 6.

Note that conductive vias 1016 and layers 1020 as used above also need not extend along both sides of substrate antenna 1000. That is, these conductive structures can also be placed along a single side to form a "C" shaped shielding structure, as desired for specific applications.

The material used to manufacture tubing 1030 or channel 1032 needs to be thick enough to prevent a majority of the energy or radiation from penetrating to an outer surface, and to form a strong enough structure for purposes of assembly. The sides of such tubing or channels need not extend the entire length of the traces, if desired, and should either be short enough or have an opening for allowing access to contact pads for the antenna.

Tubing 1030 or channel 1032 may be formed using known extrusion techniques from material such as copper, brass, or aluminum, although other materials can also be used. Tubing 1030 or channel 1032 can also be formed using a plastic shell or tubing which is then coated with conductive material. Alternatively, plastic or resin (epoxy) material having embedded conductive material could be used.

An exaggerated separation distance or dimension is shown for the space surrounding the antenna in the gap between the antenna and tubing 1030 or channel 1032, for purposes of illustration. In practice, this space is likely to be fairly small, and just large enough to allow the antenna to be slid into the interior of tubing 1030 or channel 1032. The antenna can then be secured in place using several known techniques such as using a bond agent or adhesives, a tab or bent edge on the ends of tubing 1030 or channel 1032 (or sides), or simply friction between the antenna and the interior walls.

The results of using a shielded substrate antenna according to one of the embodiments of the invention, and removing both whip antenna 104 and helical antenna 106 is readily apparent in the side plan view of FIG. 8*c*. In FIG. 8*c*, a phone 100' is shown which is the same as the phone of FIG. 1*b* but using the present invention instead of antennas 104 and 106. In this configuration, a housing 102' has been manufactured without the openings normally associated with external antennas, providing a more aesthetic appearance.

The previous description of the preferred embodiments is provided to enable any person skilled in the art to make or use the present invention. The various modifications to these embodiments will be readily apparent to those skilled in the art, such as the type of wireless device in which used, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What we claim as our invention is:

1. A shielded substrate antenna for use in wireless communication devices, comprising:

at least one non-conductive support substrate having a preselected thickness and length;

at least one conductive trace formed on said support substrate having a length and shape selected to act as an active radiator of electromagnetic energy at at least one preselected frequency;

a conductive enclosure spaced apart from and at least partially enclosing at least two sides of said conductive trace, wherein said conductive enclosure comprises at least two planar conductive shielding layers spaced apart from and on opposite sides of said conductive trace; and a conductive pad coupled to a feed end of said trace, and a passage through at least one of said planar conductive shielding layers to allow interfacing with a spring type signal contact element.

2. A shielded substrate antenna for use in wireless communication devices, comprising:

at least one non-conductive support substrate having a preselected thickness and length;

at least one conductive trace formed on said support substrate having a length and shape selected to act as an active radiator of electromagnetic energy at at least one preselected frequency;

a conductive enclosure spaced apart from and at least partially enclosing at least two sides of said conductive trace; and a conductive pad coupled to a feed end of said trace, for interfacing with a spring type signal contact element.

3. A method of shielding a substrate antenna for use in wireless communication devices, having at least one non-conductive support substrate having a preselected thickness and length with at least one conductive trace formed thereon having a length and shape selected to act as an active radiator at at least one preselected frequency, comprising:

positioning a conductive enclosure spaced apart from and at least partially enclosing two sides of said conductive trace; and forming a conductive pad coupled to a feed end of said trace, for interfacing with a spring type signal contact element.

* * * * *